US005202526A

United States Patent [19]

Ohya

[11] Patent Number: 5,202,526

[45] Date of Patent: Apr. 13, 1993

[54] APPARATUS FOR INTERPRETING WRITTEN MUSIC FOR ITS PERFORMANCE

[75] Inventor: Mayumi Ohya, Hamamatsu, Japan

[73] Assignee: Casio Computer Co., Ltd., Tokyo, Japan

[21] Appl. No.: 809,299

[22] Filed: Dec. 17, 1991

[30] Foreign Application Priority Data

| | | | |
|---|---|---|---|
| Dec. 31, 1990 | [JP] | Japan | 2-417457 |
| Dec. 31, 1990 | [JP] | Japan | 1-417458 |
| Dec. 31, 1990 | [JP] | Japan | 2-417459 |
| Dec. 31, 1990 | [JP] | Japan | 2-417460 |
| Dec. 31, 1990 | [JP] | Japan | 2-417461 |
| Dec. 31, 1990 | [JP] | Japan | 2-417462 |
| Jan. 31, 1991 | [JP] | Japan | 3-29074 |
| Jan. 31, 1991 | [JP] | Japan | 3-29075 |
| Jan. 31, 1991 | [JP] | Japan | 3-29076 |
| Jan. 31, 1991 | [JP] | Japan | 3-29077 |
| Jan. 31, 1991 | [JP] | Japan | 3-29078 |
| Jan. 31, 1991 | [JP] | Japan | 3-29079 |

[51] Int. Cl.[5] ..... G10G 3/04; G10H 1/38; G10H 1/46

[52] U.S. Cl. ..... 84/462; 84/633; 84/637; 84/DIG. 22

[58] Field of Search ..... 84/462, 609-620, 84/633-638, 649-658, 665-669, 678-690, 711-717, DIG. 12, DIG. 22, DIG. 29

[56] References Cited

U.S. PATENT DOCUMENTS

| | | | |
|---|---|---|---|
| 4,351,221 | 9/1981 | Starnes et al. | 84/462 X |
| 4,454,796 | 6/1984 | Inoue et al. | 84/462 X |
| 4,587,878 | 5/1986 | Nakada et al. | 84/462 X |
| 5,022,301 | 6/1999 | Stahnke | 84/462 X |
| 5,085,116 | 2/1992 | Nakata et al. | 84/462 X |

*Primary Examiner*—Stanley J. Witkowski

*Attorney, Agent, or Firm*—Frishauf, Holtz, Goodman & Woodward

[57] ABSTRACT

A music interpreter apparatus automatically interprets a notational music composition (written or printed music), which is abstract and incomplete to some extent, to provide its performance realization information which is specific and complete. The apparatus includes a score memory, an interpreter and a performance memory. The score memory stores a coded music notational symbol string representing a written music composition. The interpreter reads and interprets the coded music notational string based on an artificial intelligence simulating knowledge and experience of a human music interpreter or performer to provide a performance symbol string specifying the performance realization and containing played pitch, note-on time, duration and loudness parameters of specified values with respect to each note in the music composition. The resultant performance symbol string is stored into the performance memory.

9 Claims, 47 Drawing Sheets

FIG. 3

| NOTE | STEP TIME |
|---|---|
| WHOLE | 384 |
| HALF | 192 |
| QUARTER | 96 |
| EIGHTH | 48 |
| SIXTEENTH | 24 |
| THIRTY-SECOND | 12 |
| SIXTY-FOURTH | 6 |

DYNAMICS

<FORM> : dynamics (a1)

a1 : DYNAMIC MARK TYPE

EXAMPLE dynamics (mf)

DYNAMIC GRADATION MARK bCR : START OF CRESCENDO
eCR : END OF CRESCENDO
bDE : START OF DECRESCENDO
eDE : END OF DECRESCENDO

EXAMPLE

G4 : 16-(bDE) A4 : 16-B4:16(eDE)

EXAMPLE

C4 : 4(bSL) E4 : 8 G4 : 4 (eSL)

bSL : START OF SLUR eSL : END OF SLUR

CHORD

PLURAL NOTES TO BE SOUNDED SIMULTANOUSLY ARE CONNECTED BY CHORD SYMBOL "^"

EXAMPLE

FIG.25

| | RELATIVE LOUDNESS |
|---|---|
| % PART(S) SOPRANO PART BLOCK | 75 |
| % PART(A) ALTO PART BLOCK | 37.5 |
| % PART(T) TENOR PART BLOCK | 37.5 |
| % PART(B) BASS PART BLOCK | 45 |

TEMPO GRADATION MARK

| | | | |
|---|---|---|---|
| AL : | ACCELERANDO | /* accel. | */BECOMING FASTER |
| RI : | RITARDANDO | /* rit. | */SLOWING DOWN GRADUALLY |
| SG : | STRINGENDO | /* string. | */BECOMING FASTER |

EXAMPLE

C4^G4^C5^ : 4(RI)

NOTE DURATION MODIFYING SYMBOL

| CONVENTION | ML-G LANGUAGE |
|---|---|
| V | BR : BREATH |
| 𝄐 | FE : FERMATA |
| V̇ | SM : STACCATISIMO |
| • | ST : STACCATO |
| – | TE : TENUTO |

EXAMPLE

B3 : 4 (TE) E4 : 4 (TE) F4 : 4 (TE)

FORM OF MULIPLET

EXAMPLES

MULTIPLET

IN ML-G LANGUAGE, MULTIPLET (e.g., TRIPLET, QUINTUPLET) IS INDICATED BY MULTIPLET START SYMBOL "<", MULTIPLET END SYMBOL ">" AND NOTE NUMBER OF MULTIPLET

<FORM> : <a1...> /*...ARE NOTE GROUP */
a1 : NOTE NUMBER

EXAMPLE

FIG. 39

| WHOLE TIME VALUE | TRIPLET | QUINTUPLET | SEPTUPLET | NONETUPLET |
|---|---|---|---|---|
| 𝅝 | 2/3 | 4/5 | 4/7 | 8/9 |
| 𝅗𝅥 | 2/3 | 4/5 | 4/7 | 8/9 |
| 𝅘𝅥 | 2/3 | 4/5 | 4/7 | 8/9 |
| 𝅘𝅥𝅮 | 2/3 | 4/5 | 4/7 | 8/9 |

| WHOLE TIME VALUE | DUPLET | QUARTEPLET | QUINTEPLET | SEPTUPLET | OCTUPLET |
|---|---|---|---|---|---|
| 𝅗𝅥. | 3/4 | 3/4 | 3/5 | 6/7 | 3/4 |
| 𝅘𝅥. | 3/4 | 3/4 | 3/5 | 6/7 | 3/4 |
| 𝅘𝅥𝅮. | 3/4 | 3/4 | 3/5 | 6/7 | 3/4 |

APPOGGIATURA

IN ML-G LANGUAGE, APPOGGIATURA MARK (SEE BELOW) IS PLACED IN FRONT OF (APPOGGIATURA) NOTE DATA

A& : ACCIACCATURA

D& : DOUBLE APPOGGIATURA

L& : LONG APPOGGIATURA

EXAMPLE

L&D5:4 C5:2.

/* IN THIS CASE SLUR-LIKE CURVE IS CONSIDERED PART OF ORNAMENTAL NOTE */

ORNAMENT SYMBOL

MO : MORDENT

PR : PRALLTRILLER

TR : TRILL

TU : TURN

IT : INVERTED TURN

EXAMPLE

G4 : 4(MO)

APPARATUS FOR INTERPRETING WRITTEN MUSIC FOR ITS PERFORMANCE

BACKGROUND OF THE INVENTION

1. Field of the Invention

This invention relates to a music apparatus. In particular, the invention is directed to a music interpreter apparatus which interprets a notated or written music for a user.

2. Description of the Prior Art

Current electronic musical instruments having a music sequencer capability and/or a music interface between instruments (e.g., MIDI) are capable of providing music performance based on information recorded in the sequencer and/or data supplied from another instrument connected. In essence, such data is performance information (rather than written music) which completely specifies how music is played. For example, a MIDI interface voice message includes a note number indicative of a pitch of note to be played, note-on or note-off code commanding a note-on or note-off, and velocity specifying a degree of loudness.

In short, these electronic musical instruments do not handle music interpretation, but only receive music performance information supplied from a user (human performer) who enters the performance information according to his or her musical interpretation. It is, therefore, highly desired to provide an apparatus which receives a notated (written, printed) music and provides automatic music interpretation of the notation symbols for users.

SUMMARY OF THE INVENTION

An object of the invention is to provide a music interpreting apparatus which automatically interprets music information at a music notation level (written music level) to obtain complete and specified information at a performance level.

To this end, the invention provides an apparatus for interpreting a notated music which comprises: music symbol string storing means for storing a string of coded music notational symbols which represents a written music; and interpreting means for interpreting the string from the music symbol string storage means to provide performance data which specifies a pitch, note-on time, duration and loudness, of each note to be played.

This arrangement can automatically interpret a string of coded music notational symbols representing a written music composition to thereby provide desired and complete performance information specifying the performance realization of the composition.

Another object of the invention is to provide an artificial intelligence based music interpreting apparatus capable of providing desired music interpretation of a notated music (music composition set down in music notation) by simulating the art of musicianship.

A specific object of the invention is to provide an apparatus capable of interpreting dynamics which is an important aspect of music such that well-balanced loudness control is achieved in the performance as done by a human.

To this end, the invention provides an apparatus for interpreting a notated music which comprises: music symbol string storage means for storing a string of coded music notational symbols which represents a written music; and interpreting means for interpreting the string of coded music notational symbols to provide a performance symbol string containing performance information on each note. The interpreting means comprises: reference loudness evaluating means for evaluating a reference loudness of the written music based on distribution of dynamic marks contained in the string of coded music notational symbols; and individual loudness determining means for determining, from the reference loudness, loudness of each individual dynamic mark contained in string of coded music notational symbols.

With this arrangement, the reference loudness depends on the string of the coded music notational symbols, and therefore depends on the music composition represented by the string. Each individual dynamic mark is interpreted to indicate a relative degree of loudness as a function of the reference loudness, rather than to indicate fixed loudness independent of the music composition. Therefore the arrangement can achieve desired loudness changes and contrasts suitable for the music composition when it is realized by a performance.

In an embodiment, the reference loudness evaluating means selects a dynamic mark having the largest durational proportion in the music composition represented by the string of coded music notational symbols, and determines the loudness of the selected dynamic mark as the reference loudness. The individual loudness determining means determines loudness of each individual dynamic mark in the music composition as a function of the selected dynamic mark and reference loudness.

Another specific object of the invention is to provide a music interpreting apparatus capable of realizing desired phrasing, articulation, togetherness and/or shaping of a group of notes through its musical interpretation.

To this end the invention provides an apparatus for interpreting a notated music which comprises: music symbol string storage means for storing a string of coded music notational symbols representing written music; and an interpreting means for interpreting the string of coded music notational symbols to provide a string of performance data containing performance parameters of each note. The interpreting means comprises: note group affecting symbol detecting means for detecting a symbol in the string of coded music notational symbols which affects a note group; and symbol interpreting means for interpreting the detected symbol to allocate a time varying parameter to the note group affected by the detected symbol.

This arrangement can realize performance of a group of notes with desired togetherness and shaping since the note group is performed with a time varying parameter.

Another specific object of the invention is to provide a music interpreting apparatus capable of providing music interpretation of a music composition set down in music notation such that a note is played in various ways depending on presence/absence and type of a music notational symbol affecting the note.

To this end, the invention provides an apparatus for interpreting a notated music which comprises: music symbol string storage means for storing a string of coded music notational symbols representing (corresponding to) a written music; and interpreting means for interpreting the string of coded music notational symbols to provide a performance data string containing performance parameters of each note. The interpreting means comprises symbol detecting means for detecting a symbol of a predetermined type in the string of coded music notational symbols which affects a note; and loudness and duration control (modifying) means for interpreting the detected symbol to control (modify) both a performance parameter value of duration and a performance parameter value of loudness, of the note affected by the detected symbol.

With this arrangement, a note marked with a music notational symbol of a predetermined type is played in a different manner from another note without such symbol, since the performance of the note with such symbol is realized with modified values of duration and loudness parameters.

For example, in the interpretation of a tenuto symbol, a note marked with the tenuto symbol is controlled to have a duration longer than that of a note without a tenuto symbol. At the same time, the note marked with the tenuto symbol is controlled to have a degree of loudness louder than that of the note without the tenuto symbol. This will provide a desired sound contrast between notes marked with and without a tenuto symbol.

Another specific object of the invention is to provide a music interpreter apparatus capable of realizing desired musical performance by hierarchically controlling a note performance parameter based on hierarchical influence of music notational symbols at various levels in music structure on a note.

This object is essentially achieved by a music interpreter apparatus of the invention which comprises: music symbol string storage means for storing a string of coded music notational symbols representing a written music; and interpreting means for interpreting the string of coded music notational symbols to provide a performance symbol string containing performance parameters of each note. The interpreting means comprises: extensive symbol detecting means for detecting an extensive symbol in the string of coded music notational symbols which has an extensive influence; extensive symbol interpreting means for interpreting the detected extensive symbol to provide an extensive interpretation value; local symbol detecting means for detecting a local symbol in the string of coded music notational symbols which has a local influence; local symbol interpreting means for interpreting the detected local symbol to provide a local interpretation value; and performance parameter determining means for determining a performance parameter value of a note in accordance with the extensive interpretation value and in accordance with the local interpretation value.

This arrangement achieves performance realization of a note based on hierarchical music interpretation since an extensive symbol (influence of which is far-reaching) as well as a local symbol (influence of which is localized) is detected to obtain extensive and local interpretation values and to determine a performance parameter value of a note (associated with such symbols) in accordance with these interpretation values.

In an embodiment, the performance parameter determining means combines the extensive interpretation value and the local interpretation value to determine the performance parameter (e.g., loudness) of a note.

In another embodiment, the performance parameter determining means selects one of the extensive and local interpretation values depending on the type of the extensive and local symbols to determine the performance parameter value (e.g., pitch) of the note.

Another specific object of the invention is to provide a music interpreting apparatus capable of interpreting a music composition set down in music notation and having a plurality of parts or chords (plural note to be sounded simultaneously in a musical part) such that a well-balanced sound is realized during or in the performance.

To this end, the invention provides an apparatus for interpreting a notated music which comprises music symbol string storage means for storing a string of coded music notational symbols representing a written music having a plurality of parts (vocal or instrumental); and interpreting means for interpreting the string of coded music notational symbols to provide performance information on the plurality of parts containing a corresponding number of part performance blocks. The interpreting means comprises: part type identifying means for identifying a part type of each part performance block based on part symbols contained in the string of coded music notational symbols; and loudness proportion controlling means for adjusting loudness of each part performance block based on the identified part type to establish a desired volume proportion of the plurality of parts.

With this arrangement, a plurality of parts can be performed with desired volume proportions depending on their types.

The invention also provides an apparatus for providing music interpretation of a notated music which comprises: music symbol string storage means for storing a string of coded music notational symbols which represents a written music including chords; and interpreting means for interpreting the string of coded music notational symbols to provide performance information on sounds including chord members. The interpreting means comprises: chord member identifying means for identifying a type of each chord member in the performance information based on chord member symbols contained in the string of coded music notational symbols; and loudness proportion controlling means for adjusting loudness of each chord member based on the identified type to establish a desired volume proportion of chord members.

With this arrangement, each chord member is controlled to have a relative loudness suitable for its type.

To achieve desired volume proportions of a plurality of parts, a principal part or soprano part (highest pitch part) may be adjusted to have the highest degree of loudness.

To realize desired volume proportions of a plurality of chord members, the highest pitch chord member may be selected as the loudest chord member.

BRIEF DESCRIPTION OF THE DRAWINGS

The above and other objects, features and advantages of the invention will be better understood from the following description in connection with the drawings in which:

FIG. 3 shows correspondence between note values in conventional music notation and durational representation (step time) in performance symbol, string of ML-P file;

FIG. 25 shows a loudness (volume) proportion of musical parts;

FIG. 39 shows tables of coefficients each to be multiplied by a notated time value of a note in multiplet to obtain an actual note duration;

DETAILED DESCRIPTION OF THE PREFERRED EMBODIMENTS

The invention will be described in more detail taken in conjunction with the drawings.

Overall Concept

Figure 1:
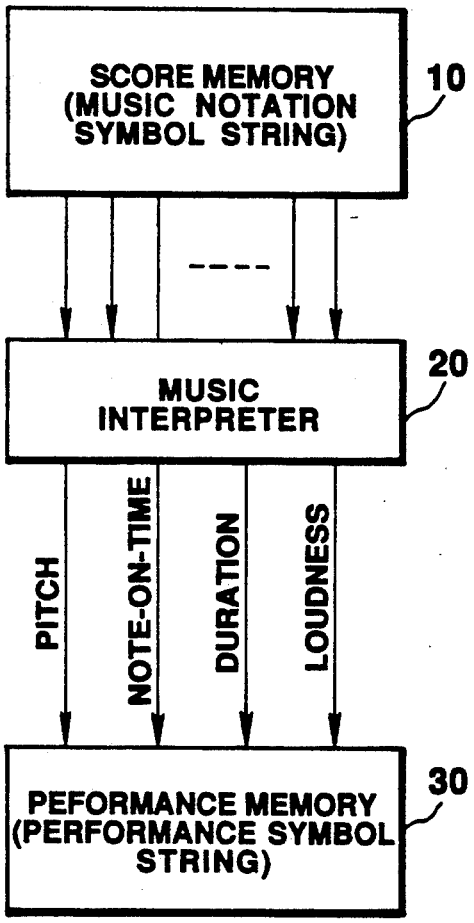
FIG. 1 is an overall functional block diagram of a music interpreter apparatus in accordance with the invention.

FIG. 1 shows an overall functional arrangement of a music interpreter apparatus in accordance with the invention. A score memory 10 stores a string of music notation symbols representing a music composition set down in music notation. Actually, each stored symbol is a code which is obtained by coding a corresponding music notation graphic symbol used in a written or printed music. Therefore, it can be said that the stored music notation symbol string represents a notated, written or printed music, or score. In other words, the stored music notation symbol string describes composer's instructions in terms of music notation. Since such instructions are incomplete and vague to some degree, music interpretation is required for their performance realization. This is done by a music interpreter 20. The music interpreter 20 receives the coded music notational symbol string from the score memory 10 and interprets it to provide a string of performance symbols which specifies performance realization of the music composition represented by the music notational symbol string. The performance symbol string contains performance information on actually played pitch, note-on time, duration and loudness of each note in the composition. Thus, the music interpreter block 20 functions as a notation-to-performance converter. The converted information i.e., performance symbol string is stored into a performance memory 30. Actual performance (i.e. sounding musical tones of the composition) can automatically be demonstrated by reading the performance symbol string data from the performance memory and controlling an electronically operated tone generator (not shown) based on the read data.

Figure 2:
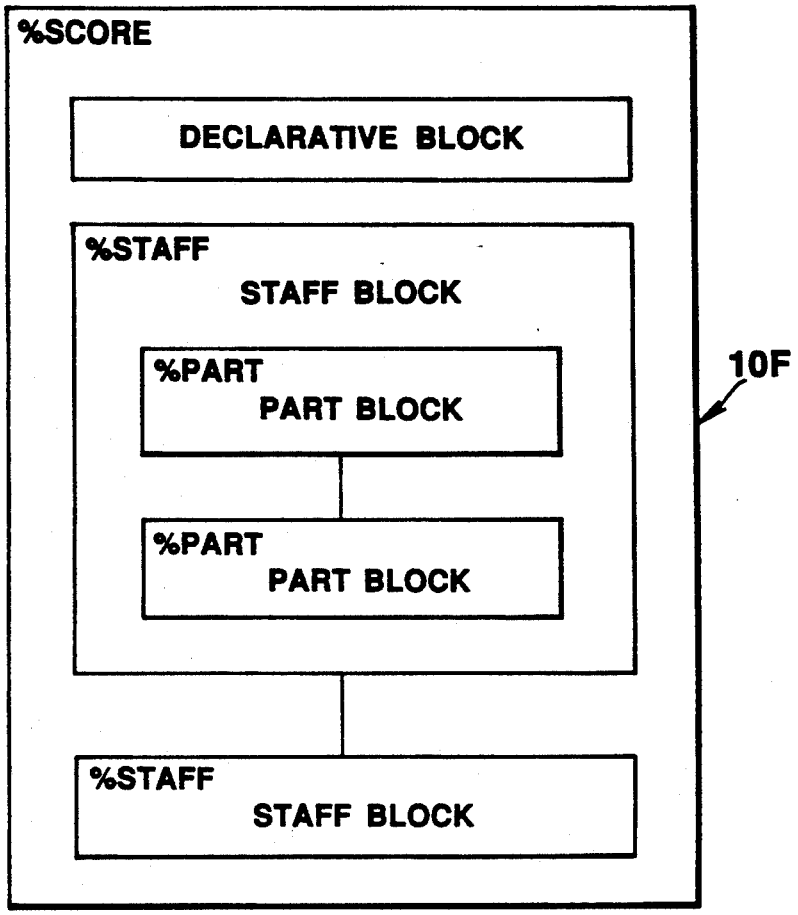
FIG. 2 shows an arrangement of MI-G file and ML-P file stored in the score memory and the performance memory, respectively, in FIG. 1.
Figure 2:
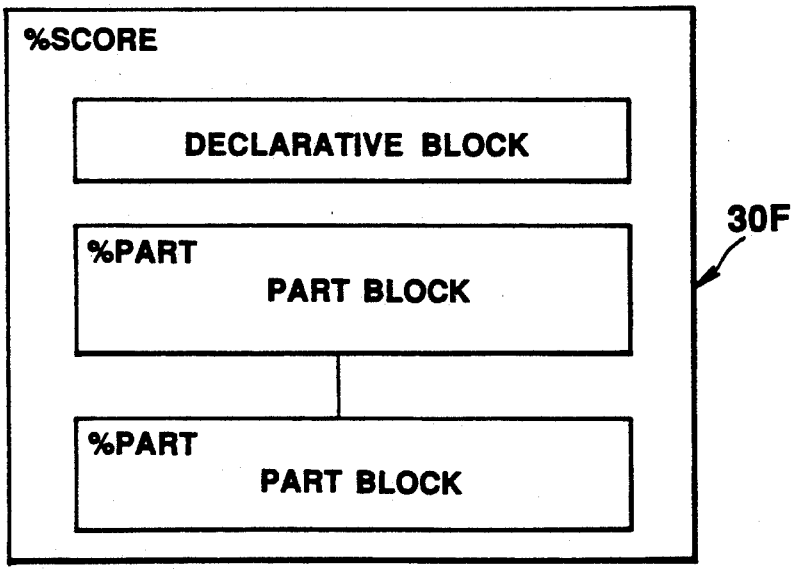

The record collection in the score memory 10 is called ML-G file, while the record collection in the performance memory 30 is called ML-P file. In FIG. 2, ML-G file is designated by 10F and comprises one declarative block and at least one staff block. Each staff block contains at least one part block. FIG. 2 also shows an arrangement of ML-P file, designated 30F, which comprises one declarative block and at least one part block.

An appendix is added at the end of the detailed description. The appendix contains "ML-G FILE EXAMPLE", "ML-G SYNTAX" "ML SYMBOL LISTING (Nos. 1-6)", "ML-P FILE EXAMPLE" and "ML-P SYNTAX".

ML-G file is described according to ML-G language (computer language for notational representation of a music composition), syntax of which is shown in "ML-G SYNTAX" appendix. "ML SYMBOL LISTING (Nos. 1-6)" shows a set of coded music notational symbols for ML-G file, i.e., a set of terminal symbols in the ML-G syntax.

ML-P file 30F is described according to ML-P language (computer language for performance representation of a music composition), syntax of which is shown in "ML-P SYNTAX" appendix.

In "ML-P FILE EXAMPLE", numbers inside of each pair of bracket symbols specify performance parameters of a note. The first (left) number is an actual pitch parameter value indicative of an actually played pitch of a note. The second number is a step time parameter value indicative of a time interval between notes. The step time determines a note-on time i.e., when note is to be sounded. The third number is a duration (gate time) parameter value indicative of a duration during which the note sound lasts. The fourth (right) number is a loudness parameter indicative of loudness of the note. In "ML-P FILE EXAMPLE", these performance parameters have a numerical range compatible with MIDI protocol.

FIG. 3 shows correspondence between note value representations in the common music language and durational (step time or gate time) representation in ML-P language. For example, the value of the whole note is equivalent to a step time (gate time) of 384 in ML-P language. The present music interpreter apparatus has several features as described in the following.

Dynamics Control

The first feature of the present music interpreter apparatus is directed to interpretation of dynamic marks. This feature is shown in FIG. 4.

Figure 4:
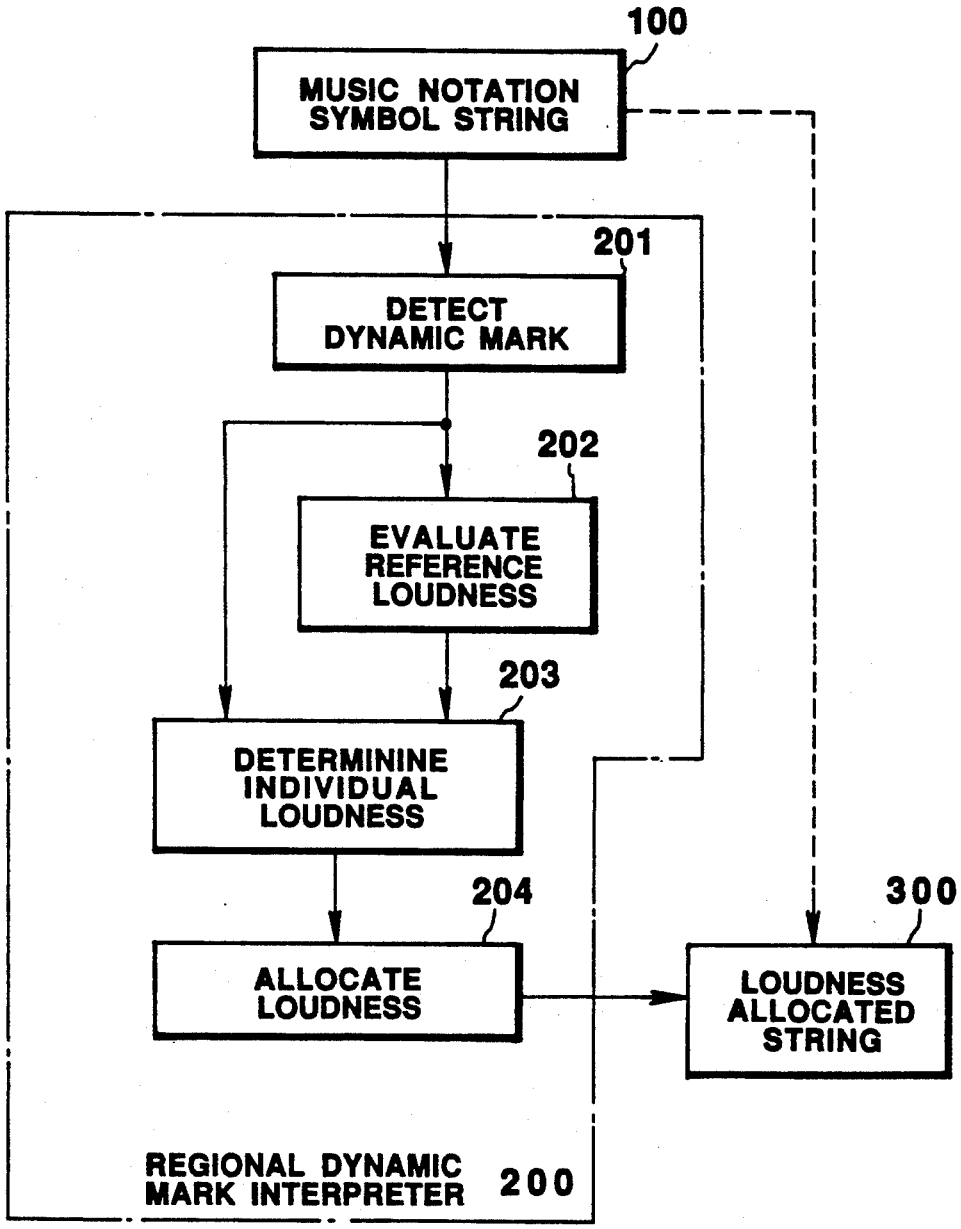
FIG. 4 is a block diagram of a regional dynamic mark interpreting module in the music interpreter of FIG. 1.

In FIG. 4, the regional (extensive) dynamic mark interpreter 200 is one of the functions of the music interpreter 20 in FIG. 1. The regional dynamic mark interpreter 200 interprets dynamic marks such as f (forte) and p (piano). The regional dynamic mark interpreter 200 includes a dynamic mark detector 201 which detects dynamic marks in the coded music notation symbol string 100. A reference loudness evaluator 202 receives the detected dynamic marks and evaluates a reference loudness of the music composition represented by the music notation symbol string 100. An individual loudness determining block 203 determines, from the evaluated reference loudness, loudness of each individual dynamic mark in the music composition. A loudness allocating block 204 allocates the determined loudness of each individual dynamic mark to notes in the range of the respective dynamic mark, as their loudness parameter value, to thereby produce a loudness allocated symbol string 300.

In place of mechanically assigning predetermined loudness values to dynamic marks in a one-to-one correspondence, the present music interpreter determines loudness of each individual dynamic mark based on the reference loudness of the music composition of interest. Therefore, each individual dynamic mark is realized in performance by a relative degree of loudness depending on the music composition rather than by an absolute or fixed loudness value independent of the composition.

Volume Proportion Control of Parts (or Chord)

The present music interpreter has a second feature which controls a volume proportion of a plurality of parts in a polyphonic music, or controls the volume proportion of a plurality of chord members (plural notes to be sounded simultaneously). This feature is illustrated in FIG. 5 in a functional block diagram.

Figure 5:
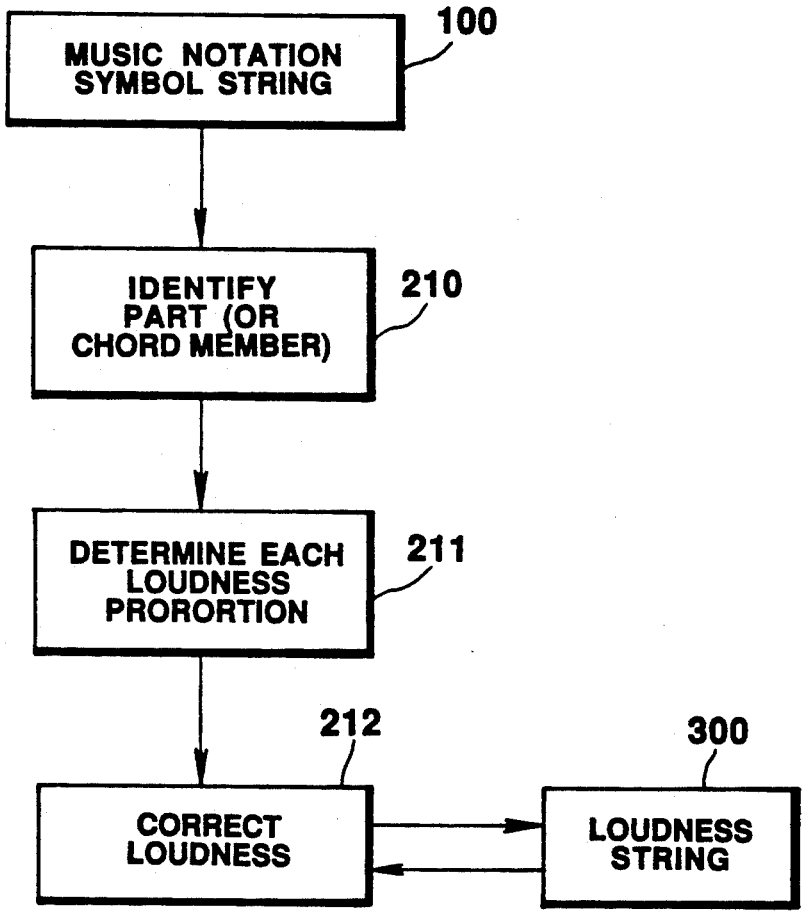
FIG. 5 is a block diagram of a volume proportion control module in the music interpreter for controlling the volume proportion of parts and/or chord members.

In FIG. 5, part (or chord member) identifying block 210 identifies the type of each part in the music notation symbol string 100, or identifies the type of each chord member when detecting a chord. The identified type information from the block 210 is passed to a loudness proportion determining block 211 which determines the loudness proportion of each part or each chord member according to its type. A loudness control 212 uses the determined loudness (volume) proportions to correct the loudness of the loudness string 300. For example, for controlling the part loudness proportion, the block 212 corrects a loudness parameter of each note following a start-of-part symbol (belonging to a particular part) in accordance with the loudness proportion of the particular part depending on its type. In the case of controlling volume proportion of chord members, the block 212 corrects a loudness parameter of each member note of a detected chord in accordance with a respective loudness proportion.

In this manner the present music interpreter apparatus establishes desired volume balance of parts or chord members by controlling a loudness parameter of each part note or each chord member note as a function of part or member type.

Hierarchical Control

Figure 6A:
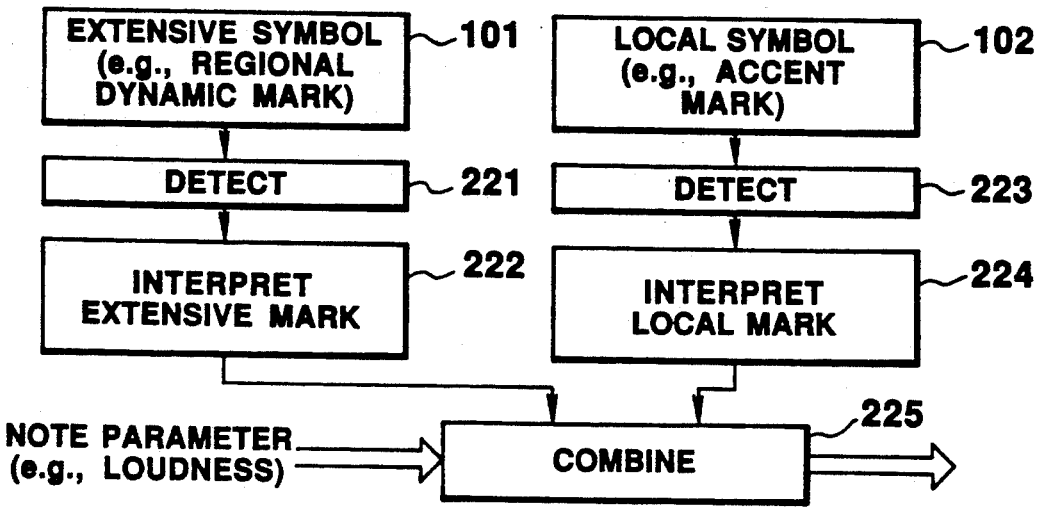
FIG. 6A is a block diagram showing a hierarchical control module of a combining type in the music interpreter.

In a written music, a plurality of symbols can affect or influence a note. Some symbols affect broadly or extensively over a number of notes. Some symbols have a localized effect. Therefore, a plurality of symbols must be considered to specify performance realization of a note. To this end, the present music interpreter apparatus has a hierarchical control function. An example of the hierarchical control is shown in FIG. 6A. Another example is shown in FIG. 6B.

FIG. 6A shows a hierarchical control of combining type. A detector 221 detects an extensive symbol 101 in the music notation symbol string 100 (e.g., an extensive dynamic mark such as f and p). An extensive symbol interpreter 222 interprets the detected extensive symbol to obtain an extensive interpretation value. Another detector 223 detects a local symbol (e.g., an accent mark affecting a single note only). A local symbol interpreter 224 interprets the detected local symbol to obtain a local interpretation value. A combining block 225 combines the extensive interpretation value from the extensive symbol interpreter 222 with the local interpretation value from the local symbol interpreter 224 to determine a note performance parameter. Suppose, for example, a note is located in the range (operative region) of f symbol as an extensive symbol, and at the same time, is marked with an accent symbol as a local symbol. Then, the extensive symbol interpreter 222 provides a loudness value, say, 80 as the interpretation value of f symbol. The local symbol interpreter 224 gives, as the result of the interpretation of the accent mark, a command of raising the loudness of a note marked with the accent symbol to 1.1 times the loudness (prevailing loudness) of a surrounding note without the accent symbol. From these interpretation values, the combining module 225 multiplies 80 (prevailing loudness) by 1.1 to obtain 88 which is used as the performance loudness parameter value of the note in question. If a note is placed in the operative region of the same f symbol but is not marked with an accent symbol, then the local mark interpreter 224 gives a command of no change of loudness. Thus, the combining block 223 outputs a loudness parameter value of 80 for the note without the accent symbol.

Figure 6B:
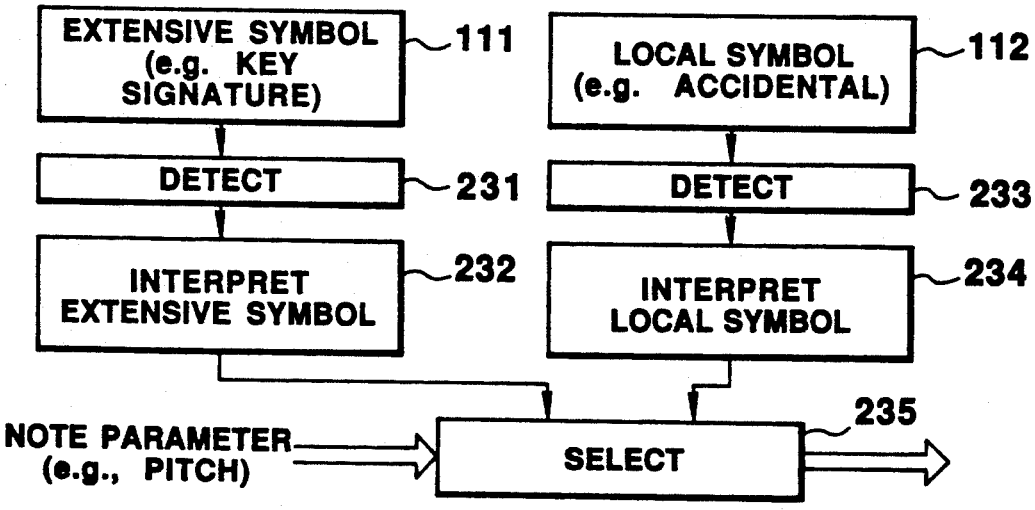
FIG. 6B is a block diagram showing a hierarchical control module of a selecting type in the music interpreter.

FIG. 6B shows a hierarchical control of selecting type. A detector 231 detects an extensive symbol 111 in the music notation symbol string 100 (e.g., key signature as an extensive pitch affecting symbol). An extensive symbol interpreter 232 interprets the detected extensive symbol. A detector 233 detects a local symbol 112 in the music notation symbol string (e.g., accidental as a local pitch modifying symbol). A local symbol interpreter 234 interprets the detected local symbol. Hierarchical control of a performance parameter, for example pitch, is achieved as follows. Suppose that the music notational symbol string has a key signature of G, and contains a note having a notated pitch E. Suppose also that the note is associated with (directly preceded by) an accidental sharp symbol which indicates raising pitch E by one semitone. In this case, the extensive symbol interpreter 232 shows, as the interpretation value of key signature of G, no change of pitch E note. The local symbol interpreter 234 gives, as the interpretation of the accidental sharp symbol, a command of raising E pitched note by a semitone. The selecting block 235 selects the local interpretation value from the local symbol interpreter 234 to set the note with the actual pitch F which is higher than the notated E by a semitone. If a note having a notated pitch of E is not marked with an accidental symbol, the selector 235 selects the extensive interpretation value from the extensive symbol interpreter 232 to set the actual pitch of the note to E.

In FIGS. 6A and 6B, the number of levels involved in the hierarchical control is two. However, the invention can readily be applied to a hierarchical control handling three or more levels of hierarchical music symbols.

Note Group Control

Another feature of the present music interpreter apparatus is to control a note group by varying its performance parameter as a function of time.

Figure 7:
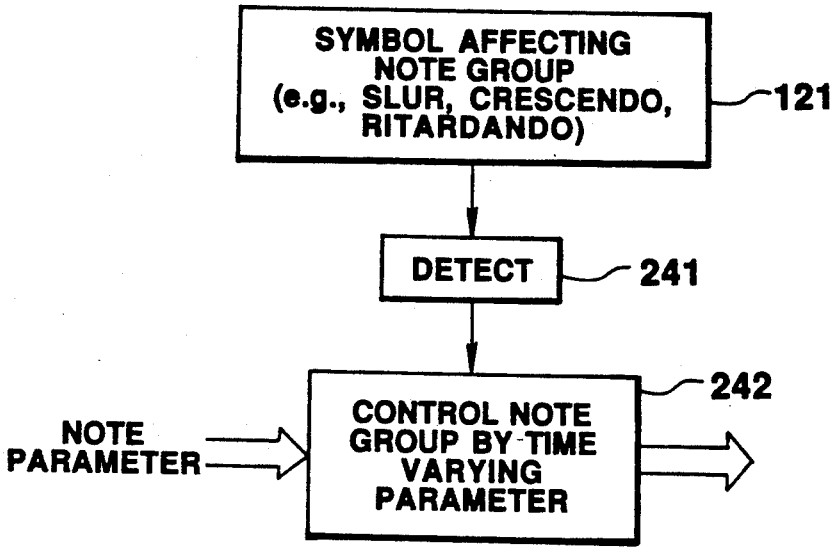
FIG. 7 is a block diagram of a note group control module in the music interpreter.

FIG. 7 shows a note group control in a functional block diagram. A detector 121 detects, in the music notation symbol string 100, a symbol 121 which affects a note group. Examples of such symbol are slur, crescendo and ritardando. The detected note-group-affecting symbol is passed to a time control 242. The time control 242 interprets the detected symbol to control a note group under the influence of the symbol by changing a performance parameter value of each note in the group with time. For example, for a slur symbol, the time control 242 provides loudness interpretation such that the group of notes with slur are performed with time varying loudness values having a peak intensity at the slur center.

The note group control serves to give the togetherness and naturalness to a note group, thus making clear a music phrase structure and realizing the performance with a flavor of musicianship.

Simultaneous Control of Loudness & Duration

Still another feature of the present music interpreter apparatus is to simultaneously control both loudness and duration of a note as the interpretation of a predetermined musical symbol associated with the note.

Figure 8:
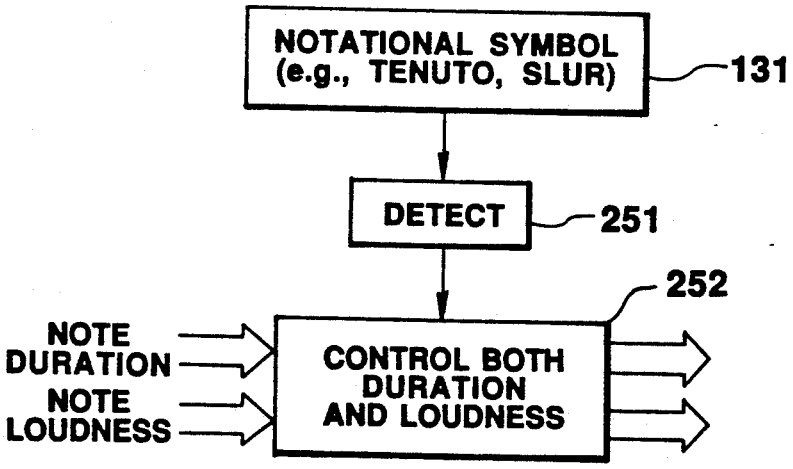
FIG. 8 is a block diagram showing a simultaneous control module in the music interpreter for controlling both the duration and loudness of a note.

FIG. 8 shows a loudness and duration control in accordance with this feature. A detector 251 detects, in the music notation symbol string 100, a symbol 131 of predetermined type associated with a note (e.g., tenuto, slur). A control block 252 interprets the detected symbol 131 to control or modify both duration and loudness of a note associated with the symbol.

Instead of interpreting a note-associated symbol as a qualifier or modifier of a single parameter of a note, the present music interpreter apparatus interprets a symbol of predetermined type such that it modifies a plurality of note parameters i.e., duration and loudness to thereby achieve desired performance realization of such symbol.

System Organization

Figure 9:
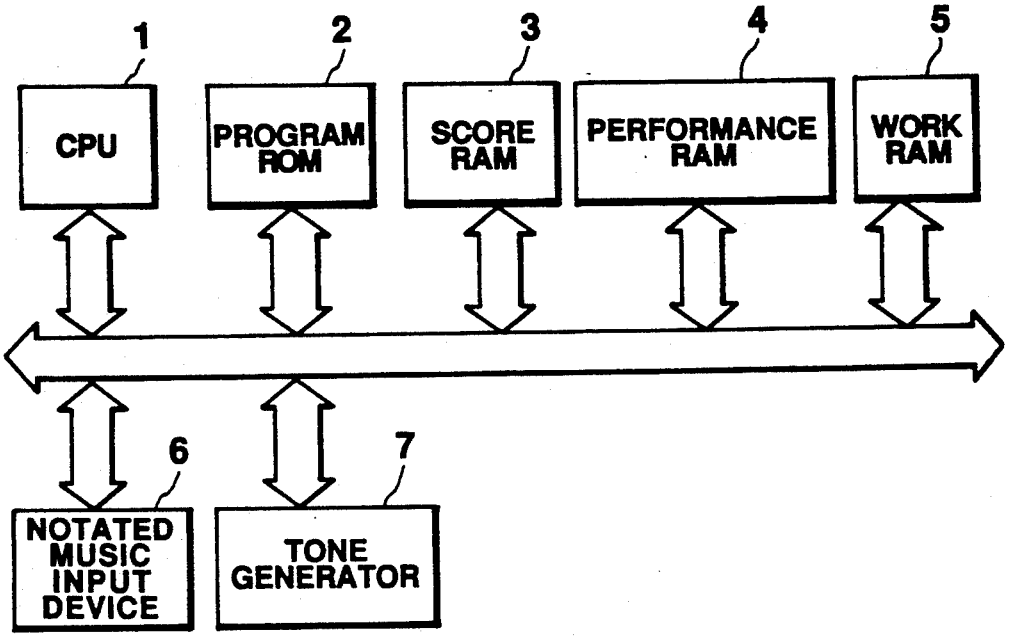
FIG. 9 is a hardware block diagram showing a representative system arrangement for implementing the music interpreter.
Figure 10:
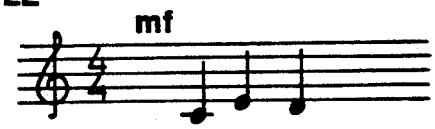
FIG. 10 shows coding of dynamic marks according to ML-G language.

FIG. 9 is a hardware block diagram of a representative system for implementing the music interpreter apparatus described so far. The entire system operates under the control of CPU1. A program ROM2 stores required programs including a music interpreting program. A score RAM3 corresponds to the score memory 10 in FIG. 1, and stores a coded music notation symbol string (example is shown in "ML-G FILE EXAMPLE") entered from a notated music input device 6 which may take the form of a keyboard commonly used in a computer system. A performance RAM4 corresponds to the performance memory 30 in FIG. 1, and stores a performance symbol string (an instance is shown in "ML-P FILE EXAMPLE" appendix) as the results of music interpretation of a notation music. A work RAM5 is used as a working memory of CPU1 during the program run. CPU1 may control a tone generator 7 based on the performance symbol string stored in the performance RAM4, thus providing automatic performance of a notated music according to its music interpretation.

In place of a keyboard, the notated music input device 6 may be implemented by a score image scanner which reads an image on a score printed sheet. In this case, a score recognition program is required in the program ROM2 to recognize music notational symbols from the scanned score image data to obtain a coded music notation symbol string such as the one shown in "ML-G FILE EXAMPLE" appendix.

Details of Music Interpretation

In the following, interpretation of respective music notational symbols is described in detail.

Interpretation of Dynamic Marks (FIGS. 10–14)

In ML-G language, a dynamic mark (e.g., f, p) is coded or spelled by "dynamics (al)" in which variable al represents type or name of the dynamic mark.

Figure 11:
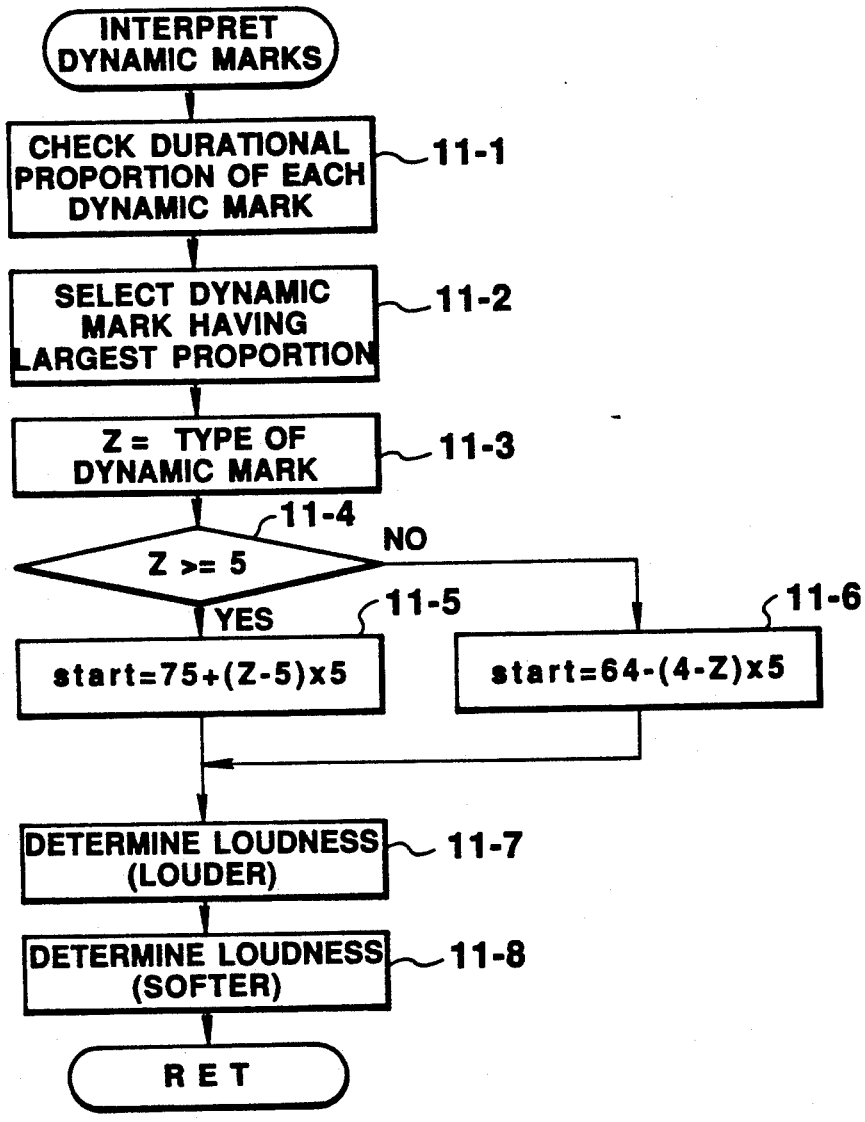
FIG. 11 is a flow chart of an interpret dynamic marks routine executed by CPU in FIG. 9.
Figure 12:
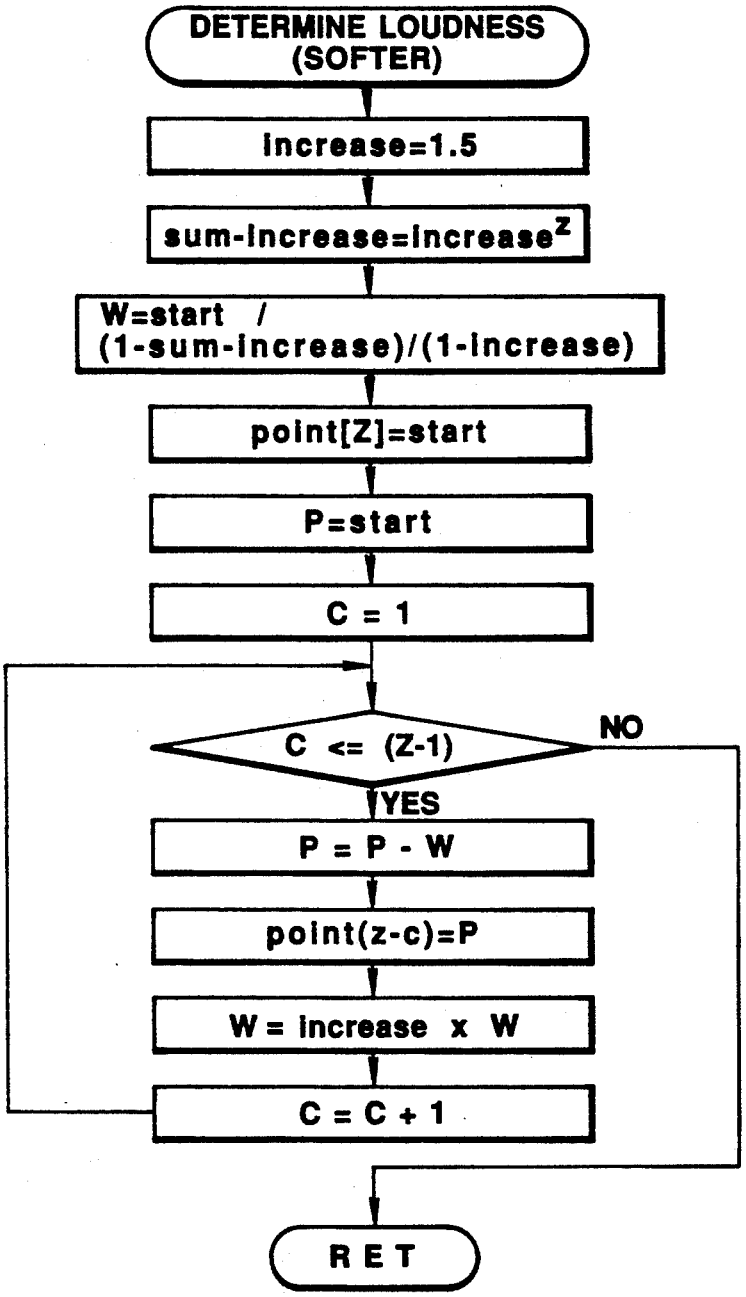
FIG. 12 is a flow chart of the determine loudness (softer) block 11-8 in FIG. 11.
Figure 13:
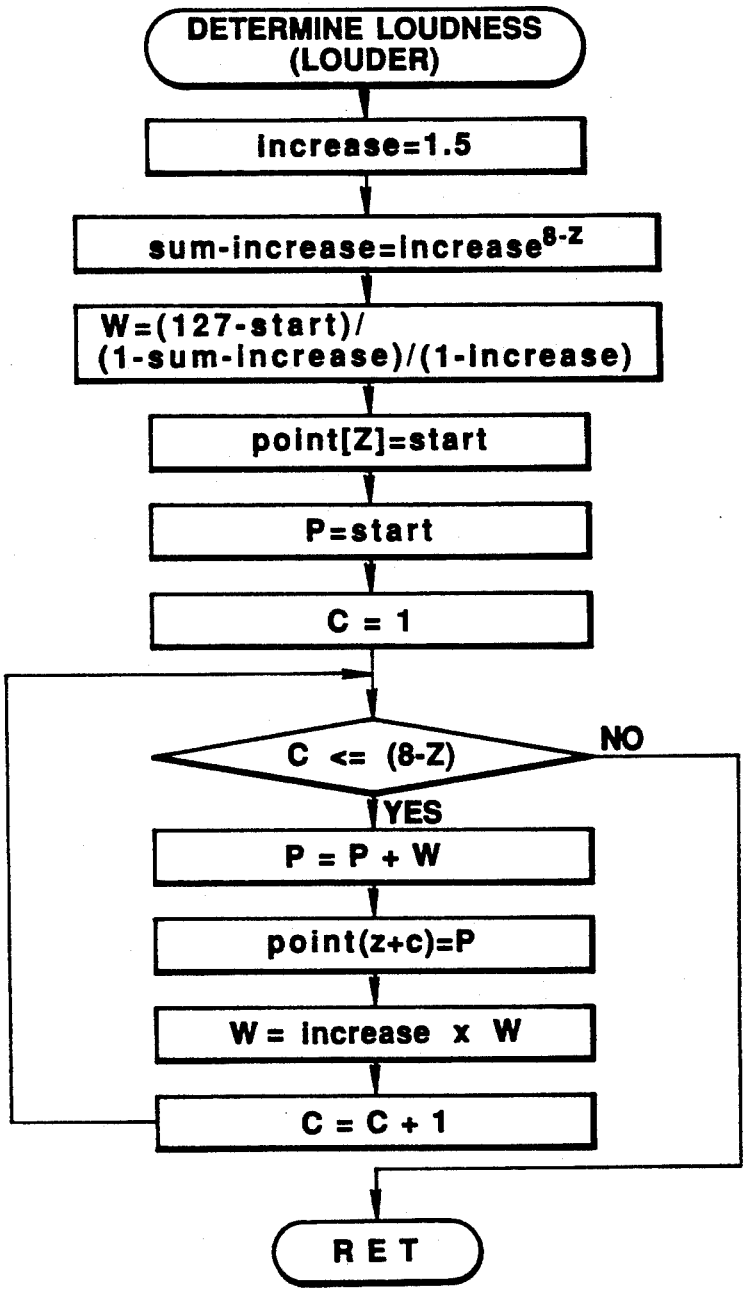
FIG. 13 is a flow chart of the determine loudness (louder) block 11-7 in FIG. 11.
Figure 14:
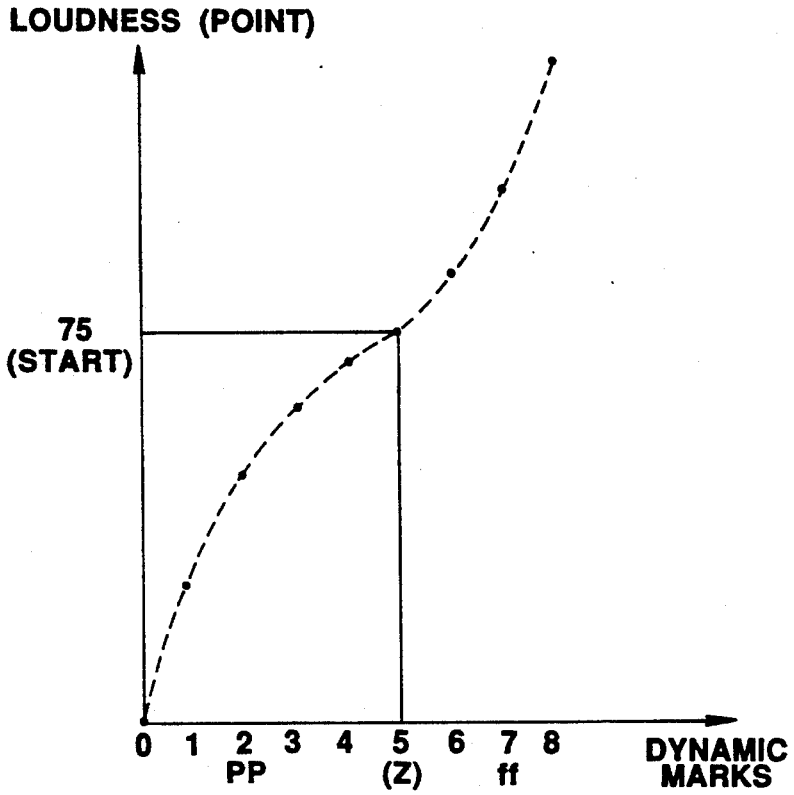
FIG. 14 is a graphic representation of the interpretation of dynamic marks.

FIGS. 11–13 show flow charts of an interpret dynamic marks routine executed by CPU1. FIG. 14 is a graph illustrating how dynamic marks are interpreted.

The interpret dynamic marks routine (FIG. 11) detects dynamic marks in the stored music notation symbol string representing a notated music composition, and checks durational proportion of each dynamic mark to the entire length of the music composition (11-1). Then the routine selects the dynamic mark Z having the largest proportion as the reference dynamic mark of the music composition (11-2). The routine computes the reference loudness value "start" of the music composition from the reference dynamic mark (11-4 to 11-6). Then the routine determines the loudness value (volume level in performance) of each individual dynamic mark other than the reference dynamic mark Z (11-7 and 11-8).

In FIG. 14, mf (represented by number "5") is chosen as the reference dynamic mark Z. The reference loudness value "start" is 75, specifying the performance realization of the dynamic instructing mark mf. In the present apparatus, the loudness parameter corresponds to the velocity data in MIDI and has the same numerical range of 0–127.

The loudness value of louder dynamic marks i.e., those marks louder than the reference dynamic mark Z is determined according to the determine loudness (louder) routine shown in FIG. 13. The loudness value of softer dynamic marks i.e., those marks softer than the reference dynamic mark Z is determined according to the determine loudness (softer) routine shown in FIG. 12. What is important is that each dynamic mark is interpreted as indicating loudness as a function of the reference loudness "start" of the reference dynamic mark Z.

According to the routine of FIGS. 12 and 13, the loudness parameter for a softer dynamic mark is determined by using a decrement amount W as:

$$W=(\text{start})/(1-\text{sumincrease})/(1-\text{increase})$$

in which sumincrease=Z-th power of increase.

The loudness parameter for a louder dynamic mark is determined by using an increment amount W as:

$$W=(127-\text{start})/(1-\text{sumincrease})/(1-\text{increase})$$

in which sumincrease=(8−Z)-th power of increase.

As noted, W depends on the selected reference dynamic mark and the reference loudness value "start". A dynamic mark (Z−1) which is softer than the reference dynamic mark Z by one degree is interpreted as a loudness value which is smaller than the reference loudness value "start" by W. A dynamic mark (Z−2) which is two degrees softer than the reference dynamic mark Z is interpreted as a loudness value which is smaller than the reference loudness value "start" by (1+increase)W. In general, a dynamic mark (Z−C) is specified by the loudness value Point(Z−C):

$$\text{Point}(Z-C)=\text{start}-(1+i+i^2+\ldots+i^C)W$$

in which i=increase.

On the other hand, a dynamic mark (Z+C) which is C degree louder than the reference is interpreted as the loudness value Point(Z+C):

$$\text{Point}(Z+C)=\text{start}+(1+i+i^2+\ldots+i^C)W.$$

As having been apparent from the foregoing, executing the routines of FIGS. 11–13 realizes the dynamics control function described in connection with FIG. 4.

Figure 15:
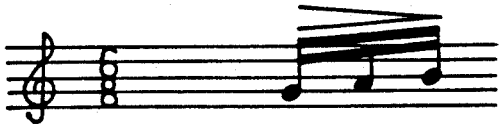
FIG. 15 shows coding of dynamic gradation marks according to ML-G language.
Figure 16:
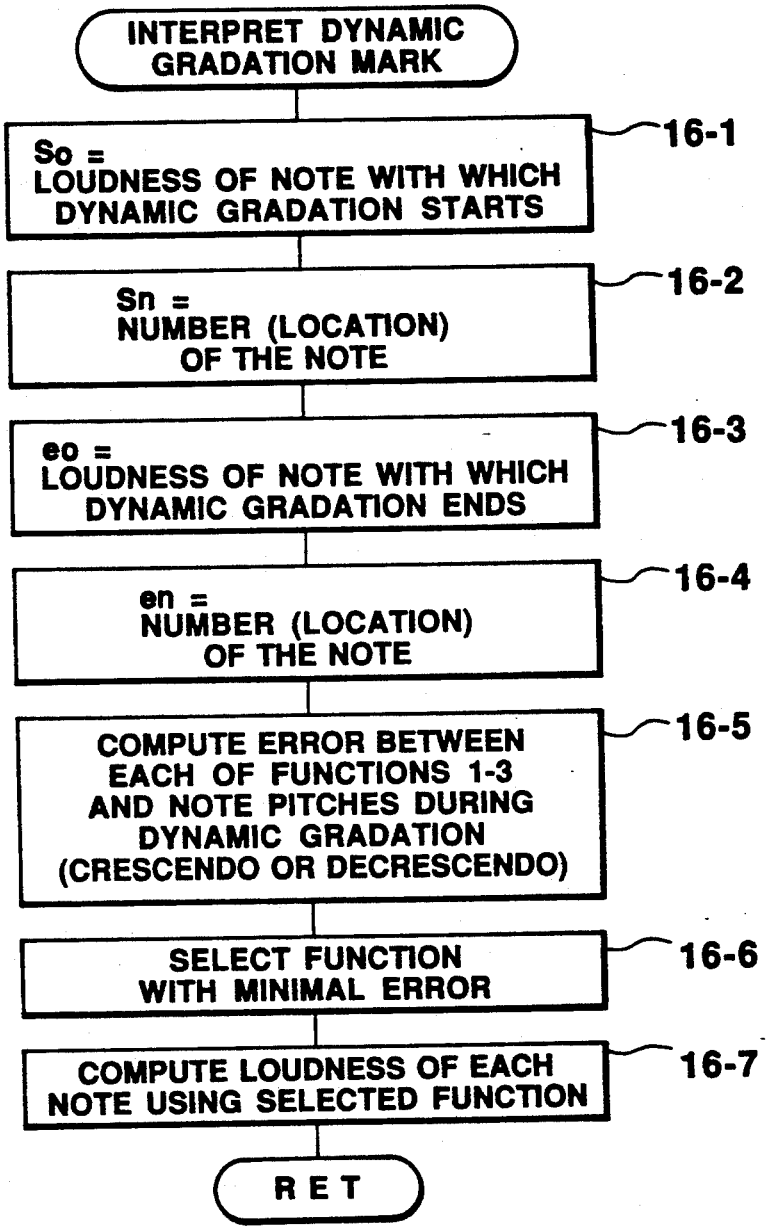
FIG. 16 is a flow chart of an interpret dynamic gradation mark routine.
Figure 17:
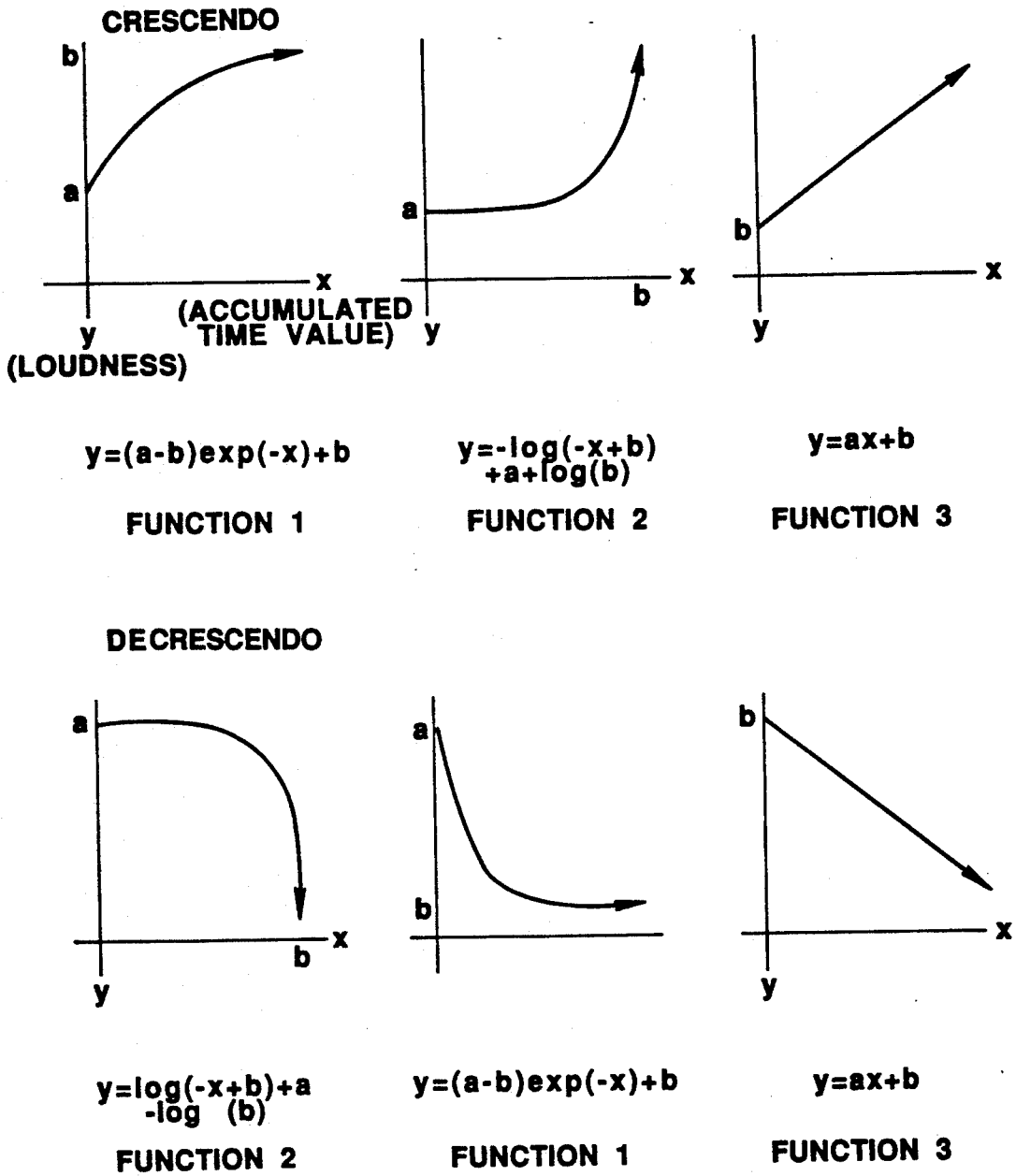
FIG. 17 is a graphic representation of time-varying loudness functions used in the interpret dynamic gradation mark routine.

Interpretation of Dynamic Gradation (FIGS. 15–17)

The description now takes up the interpretation of dynamic gradation marks such as crescendo and decrescendo.

In ML-G language, crescendo (mark commanding gradual increase in loudness) is coded by a start-of-crescendo symbol bCR and an end-of-crescendo symbol eCR. Decrescendo (mark indicative of gradual decrease in loudness) is represented by a start-of-decrescendo symbol bDE and an end-of-decrescendo symbol eDE (see FIG. 15). Therefore, the coded music notational symbol string represents a region of crescendo between a symbol bCR and a symbol eCR. A decrescendo zone is defined from a symbol bDE to a symbol eDE.

In the example of FIG. 15, a decrescendo starts with a sixteenth note of pitch G in a fourth octave (coded by G4:16) and ends with a sixteenth note of pitch B in the fourth octave (coded by B4:16).

FIG. 16 shows a flow chart of an interpret dynamic gradation mark routine. The routine looks for a symbol pair bCR and eCR of crescendo, or bDE and eDE of decrescendo in the coded music notational symbol string. When it detects such a symbol pair of dynamic gradation, the routine reads the loudness SO of the note (starting note) with which the dynamic gradation starts, location of the starting note $s_n$, loudness eO of the note (ending note) with which the dynamic gradation ends, and location of the ending note $e_n$ (16-1 to 16-4). Here, the loudness of the starting and ending notes has been determined by the interpretation of dynamic marks mentioned earlier with respect to FIGS. 10–14.

Then the interpret dynamic gradation mark routine executes 16-5 to 16-7 to allocate a time varying loudness parameter to those notes between the gradation starting note and the gradation ending note. To this end, the routine of FIG. 16 associates loudness with pitch by selecting a time varying loudness function which best fits the pitch variation in the note group from the gradation start to end notes. Specifically, the shape of a pitch succession formed by those notes between the gradation starting and ending notes is matched against each of the functions 1–3 shown in FIG. 17, specified by using the initial loudness SO at the gradation start and the final loudness eO at the gradation end to compute their difference or error. The function having the smallest error is selected to determine loudness parameter values of notes in the loudness gradation region. If, for example, function 1 is selected, loudness increasing rate becomes smaller as time goes on. According to function 2, the loudness increasing rate becomes greater with time. If function 3 is used, the loudness increasing rate is kept constant so that the loudness increases linearly with time.

In this manner the music interpreter apparatus realizes the note group control function described in connection with FIG. 7. Furthermore, the hierarchical control of FIG. 6A is realized by the combination of interpretation of dynamic marks and the interpretation of dynamic gradation marks.

Figure 18:
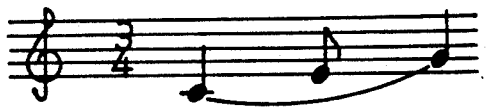
FIG. 18 shows coding of a slur symbol according to ML-G language.
Figure 19:
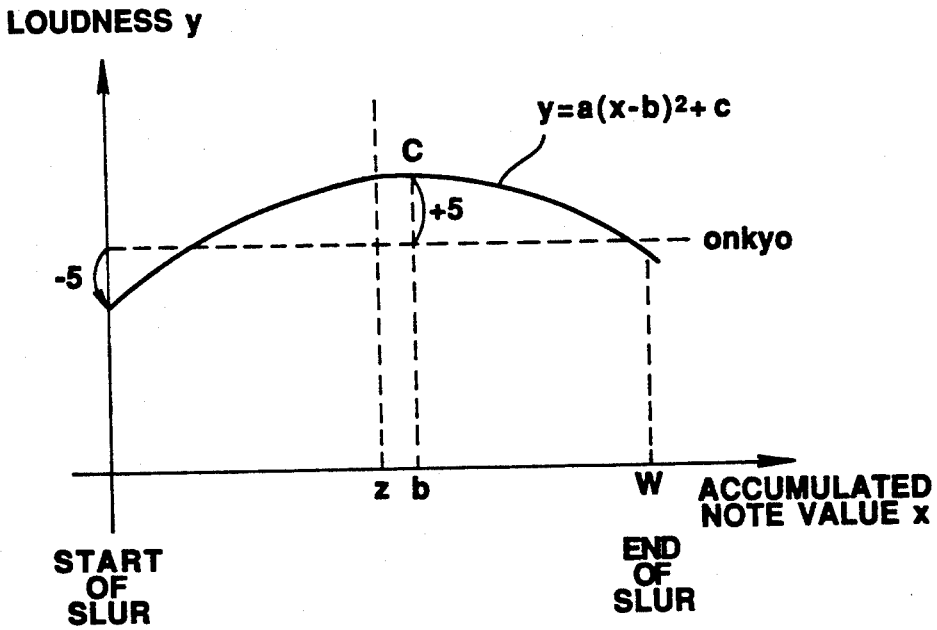
FIG. 19 is a graphic representation of a function for time-varying loudness of a note group marked with a slur symbol.
Figure 20:
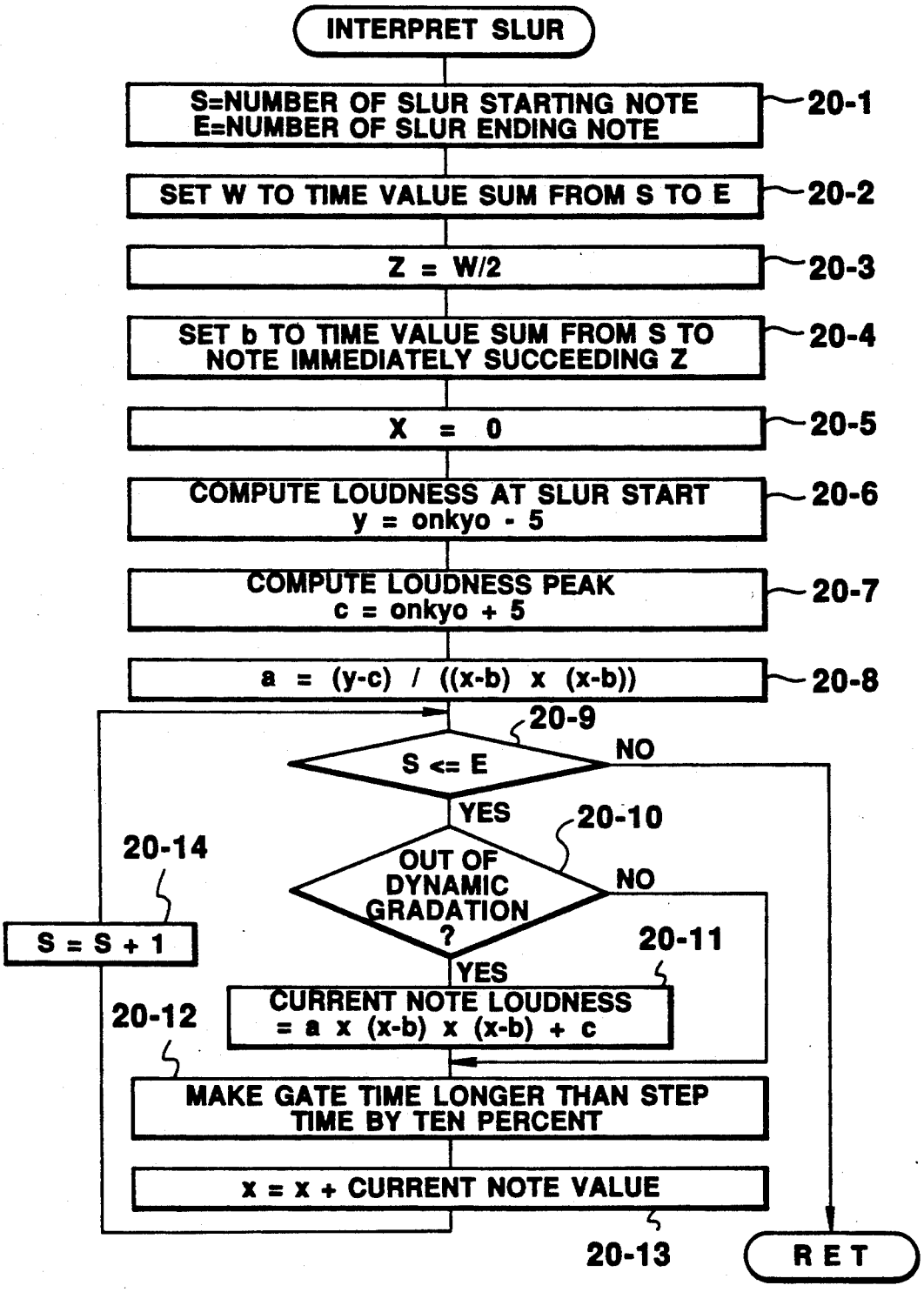
FIG. 20 is a flow chart of an interpret slur routine.

Interpretation of Slur (FIGS. 18–20)

In ML-G language, slur is coded by a start-of-slur symbol bSL and an end-of-slur symbol eSL (see FIG. 18).

In the example of FIG. 18, a slur starts with a quarter note of C4 and ends with quarter note of G4.

FIG. 20 shows an interpret slur routine. A feature of this routine is to control a group of notes marked with a slur symbol with a time varying loudness parameter in order that a phrase or structural unit of music will be clearly perceived from the performance of the note group with a slur. This feature realizes the note group control function described in connection with FIG. 7. Another feature of the interpret slur routine prolongs the actual duration (gate time) of each note with a slur beyond its step time. These features realize the simultaneous loudness and duration control described in connection with FIG. 8.

FIG. 19 graphically illustrates loudness control of the interpret slur routine. The loudness of the note group in the slur region changes with time according to a time varying function y:

$$y=a(x-b)^2+c$$

In the function, c is the peak value of the loudness, and b is a time point of the loudness peak. The b is specified by the location of the note directly after the center of the slur interval. The loudness peak c is given by (ONKYO+5) in which ONKYO is a prevailing loudness value which a note without a slur would have and which has already been determined by the interpretation of dynamic marks mentioned earlier. Therefore, in the slur region, the loudness increases, reaches its peak near the slur center and then decreases.

The routine of FIG. 20 executes steps 20-1 to 20-8 to get the location S of the slur starting note, the location E of the slur ending note and coefficient values a, b and c of the time varying loudness curve y. Then the routine executes steps 20-9 to 20-14 to determine loudness parameters and gate time (actual duration) parameters of notes between the slur starting and ending notes. In particular, the step 20-11 computes the loudness of a note according to time varying loudness curve y. The step 20-12 makes the gate time of the note longer than its step time by ten percent. The initial value of the step time is computed by converting a notated note value (e.g., 4 for a quarter note) in the ML-G language coded music notational symbol string according to the converting table of FIG. 3.

The interpret slur routine uses a reference loudness value ONKYO which is the results of the interpretation of a prevailing dynamic mark (extensive mark) to determine the loudness curve in the slur zone. Thus the interpret slur routine in combination with the interpret dynamic marks routine realizes the hierarchical control of FIG. 6A.

If the slur zone overlaps the zone of the dynamic gradation mark such as crescendo and decrescendo (NO in step 20-10), the routine skips over the loudness computing step 20-11 to make effective the interpretation of the dynamic gradation mark, thus giving the dynamic gradation mark an advantage over the slur with respect to loudness control.

Figure 21:
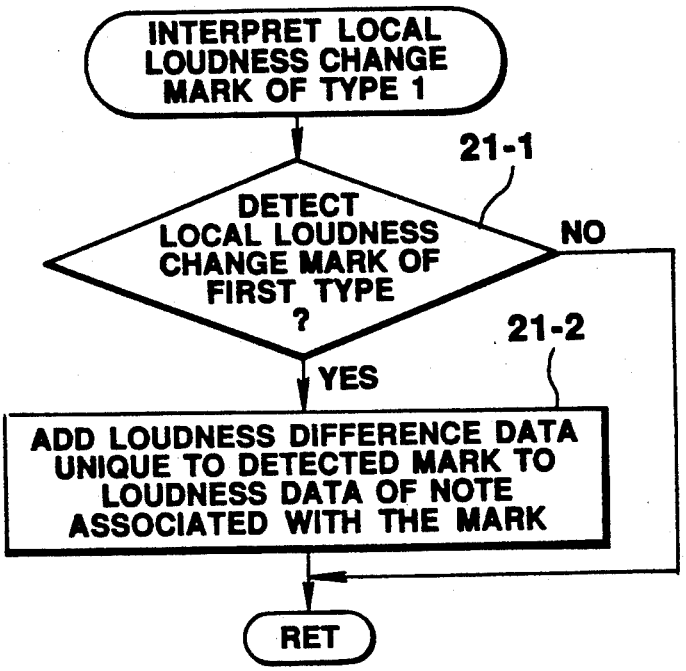
FIG. 21 is a flow chart of an interpret local loudness change mark of type 1 routine.
Figure 22:
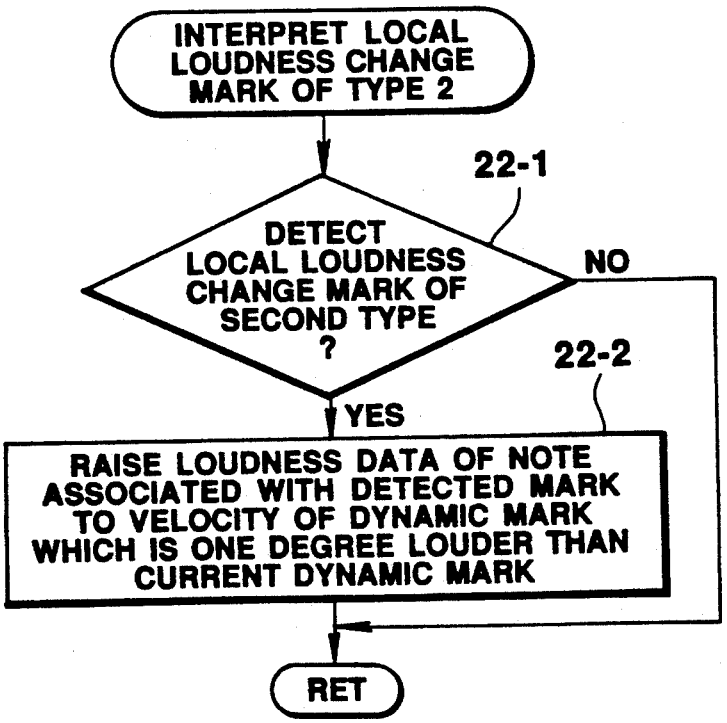
FIG. 22 is a flow chart of an interpret local loudness change mark of type 2 routine.

Interpretation of Local Loudness Change Marks (FIGS. 21 and 22)

Local loudness modification (typically enhancement) of a single note is indicated by a local loudness change symbol or mark such as accent, sforzando, forzando and rinforzando. The interpreter of such loudness change mark uses, as a reference prevailing loudness, the interpretation value of a more extensive dynamic mark which affects a succession of notes including a note marked with a local loudness change symbol. The routine of FIG. 11 may provide such prevailing loudness level. Then the local loudness change mark interpreter specifies the loudness of the note marked with the local loudness change mark based on the prevailing loudness. In this manner, the note loudness is hierarchically determined so that the hierarchical control function of FIG. 6A is realized.

FIG. 21 shows a flow chart of an interpret local loudness change mark of type 1 routine while FIG. 22 shows a flow chart of an interpret local loudness change mark of type 2 routine.

In FIG. 21, step 21-1 detects a local loudness change mark of type 1 (e.g., accent) in the music notational symbol string. Step 22-1 in FIG. 22 detects a local loudness change mark of type 2 (e.g., sforzando).

When it detects a local loudness change mark of the first type, the routine of FIG. 21 gets the prevailing loudness which is either the interpretation value of a prevailing dynamic mark obtained from the interpret dynamics routine (FIG. 11) or the interpretation value of a prevailing dynamic gradation mark (if any) obtained from the interpret dynamic gradation mark routine (FIG. 16). Then the routine adds loudness difference data assigned to the detected local loudness change mark to the prevailing loudness to thereby specify the loudness of the note associated with the local loudness change mark (21-2).

When a local loudness change mark of the second type is detected, step 22-2 increases the loudness of the note to the level obtained for the dynamic mark (e.g., f) which is one degree louder than the prevailing dynamic mark (e.g., mf).

Figure 23:
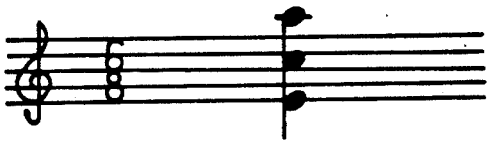
FIG. 23 shows coding of a chord according to ML-G language.
Figure 24:
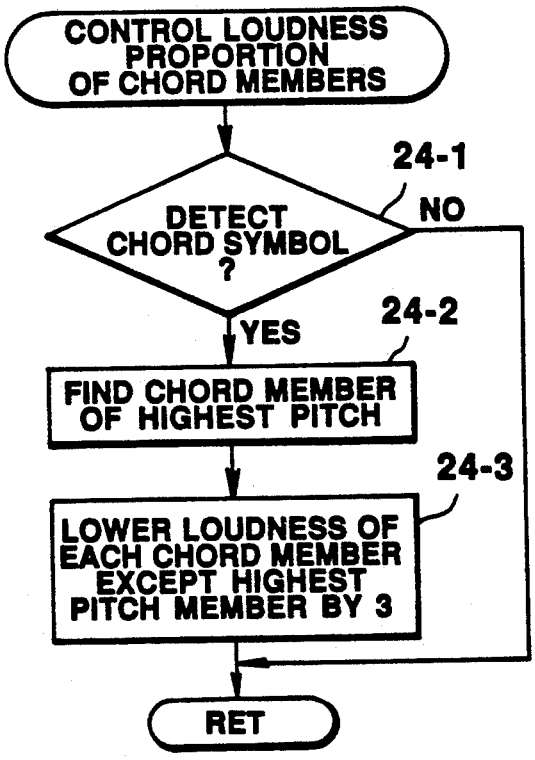
FIG. 24 is a flow chart of a control loudness proportion of chord members routine.

Interpretation of Chord (FIGS. 23 and 24)

In ML-G language, a chord (plural notes to be sounded simultaneously) is represented by chord or simultaneity symbol " ^ " connecting note pitch symbols.

In the example of FIG. 23, a chord formed by quarter notes of pitches E in the fourth octave, C and A in the fifth octave is coded by "E4 ^ C5 ^ A5:4".

FIG. 24 shows a control loudness proportion of chord members routine. The routine looks for a chord in the music notational symbol string. If a chord is detected (24-1), the routine finds a chord member of the highest pitch (24-2). In the example of FIG. 23, A5 is the highest pitch chord member. Then step 24-3 lowers loudness data of each chord member other than the highest by 3 so that the highest pitch chord member will be sounded louder than the other chord members, realizing the desired chord sound.

In this manner, the routine of FIG. 24 controls loudness proportions of the chord members according to their type (relative pitch position) to thereby achieve the volume proportion control function discussed in connection with FIG. 5.

Figure 26:
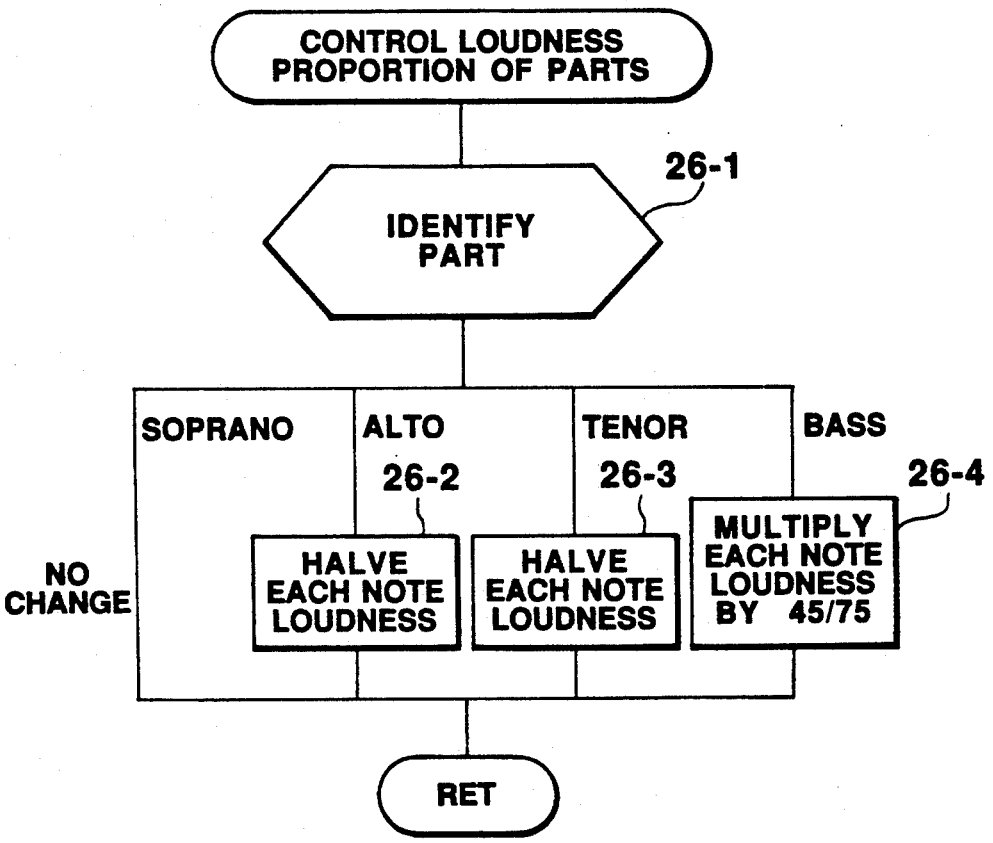
FIG. 26 is a flow chart of a control loudness proportion of parts routine.

Volume Proportion Control of Parts (FIGS. 25 and 26)

As mentioned with respect to FIG. 2, the present music interpreter apparatus can treat a music composition having a plurality of parts. In the coded music notational symbol string stored in RAM3, each part data block is headed by a start-of-part symbol part(x) in which x indicates a part type.

As discussed in connection with FIG. 5, the present music interpreter has the function of controlling the volume proportions assigned to respective parts of a music composition.

In the example of FIG. 25, soprano, alto, tenor and bass parts are assigned volume proportions of 75, 37.5, 37.5 and 45, respectively.

FIG. 26 shows a control loudness proportion of parts routine. This routine is executed after the other interpreting operations (including interpretations of dynamic marks, dynamic gradation marks and local dynamic change marks) have been completed with respect to each part.

Step 26-1 detects a start-of-part symbol % part(x) in the performance symbol string in the performance RAM4, and reads x to identify the type of the part, data of which is written in the following part block. If the identified part type is soprano, the data in the following part block (i.e., soprano part block) remains unchanged. If the identified type is either alto or tenor, all note loudness parameters in the following part block are halved (26-2, 26-3). If the identified type is bass, a loudness parameter of every note in the following part block is multiplied by 45/75. In this manner, soprano, alto, tenor and bass parts are volume-controlled in accordance with the loudness proportion allocation shown in FIG. 25.

As a result, when the composition is performed, the soprano part will be heard most conspicuously, the bass will be secondarily impressive while the inner voices i.e., tenor and alto parts will support the polyphonic sonority with their less intensive loudness, thus achieving a desired sound as a whole.

Interpretation of Tempo Gradation Marks (FIGS. 27-31)

Figure 27:
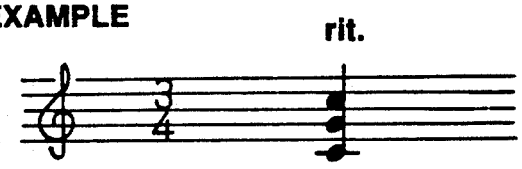
FIG. 27 shows coding of tempo graduation marks according to ML-G language.

These marks such as accelerando, ritardando and stringendo are used to introduce gradual change in tempo. As shown in FIG. 27, ML-G language codes accelerando by AL, ritardando by RI and stringendo by SG.

Figure 28:
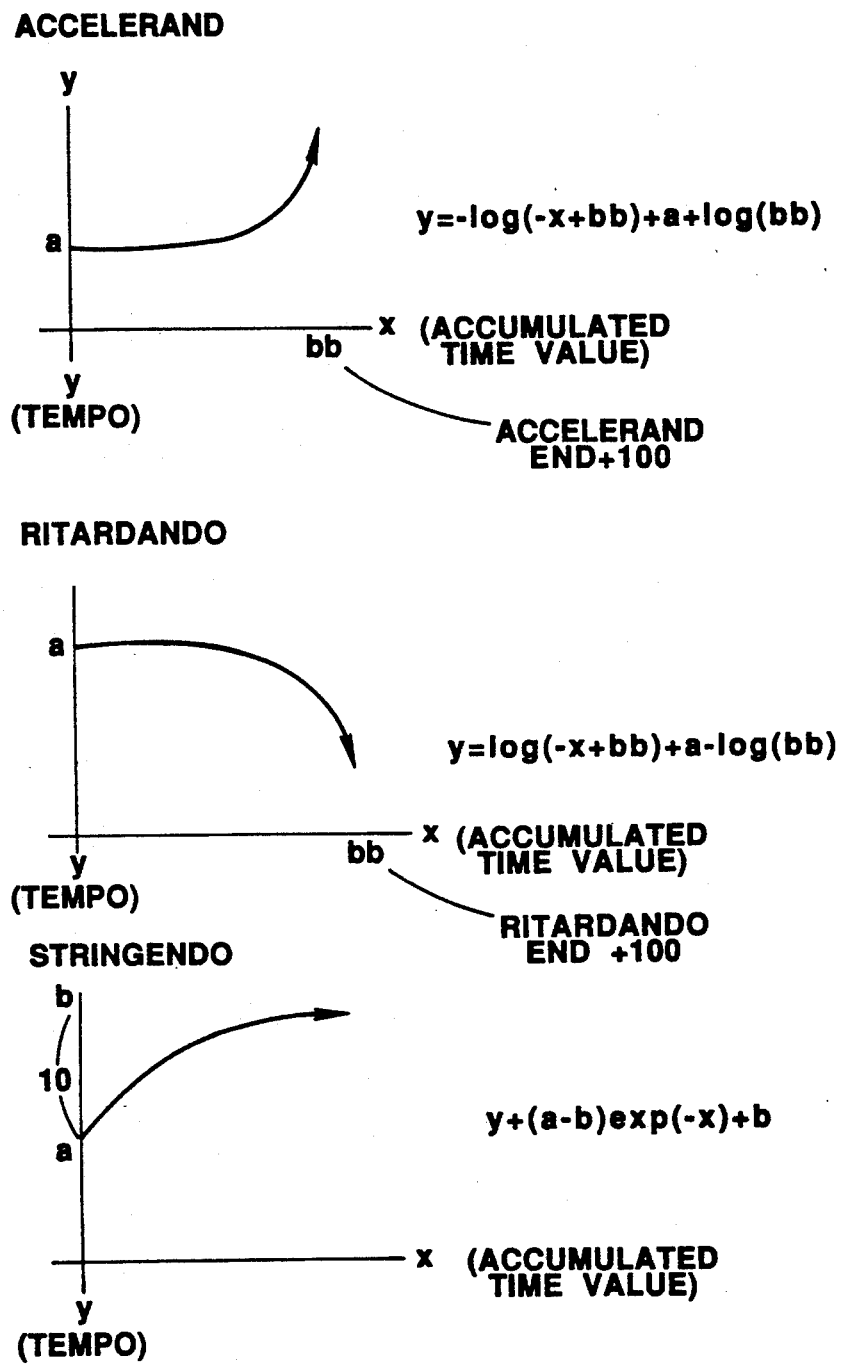
FIG. 28 is a graphic representation of functions for use in the interpretation of tempo graduation marks.

FIG. 28 shows tempo functions useful for accelerando, ritardando and stringendo, respectively.

Figure 29:
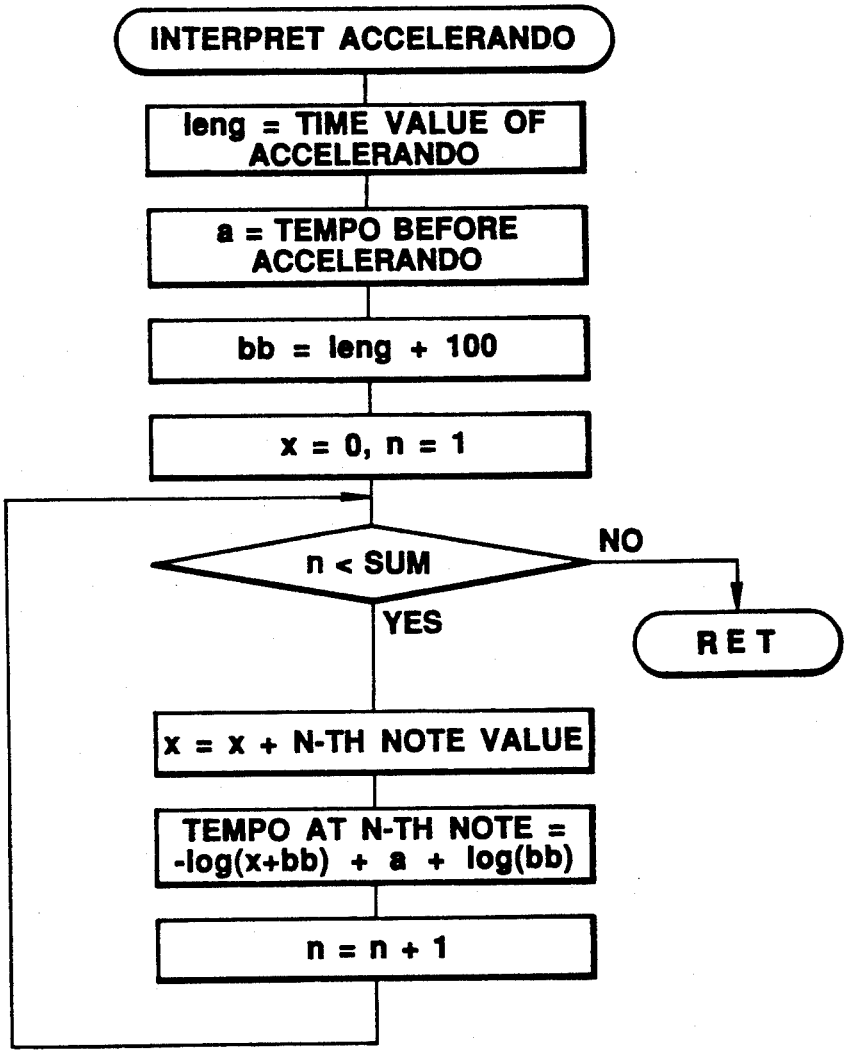
FIG. 29 is a flow chart of an interpret accelerando routine.
Figure 30:
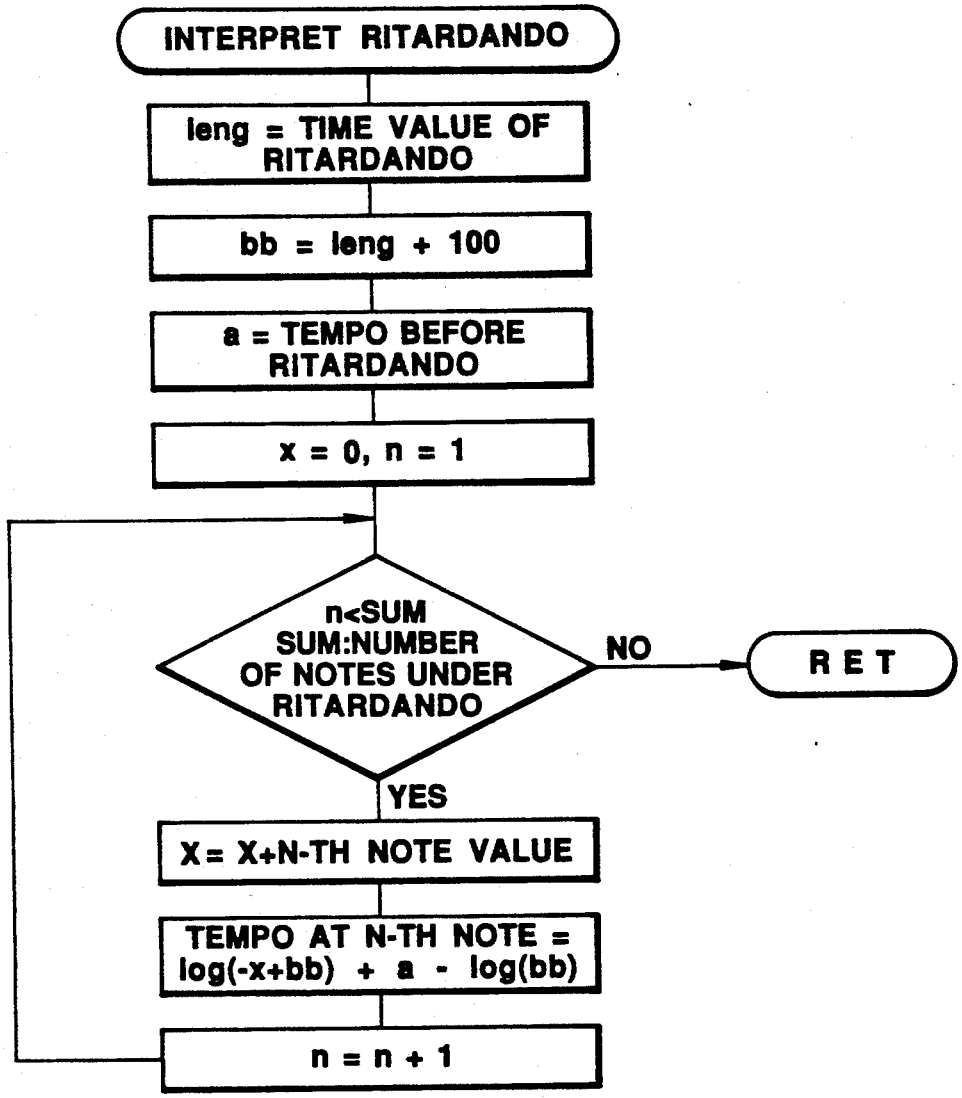
FIG. 30 is a flow chart of an interpret ritardando routine.
Figure 31:
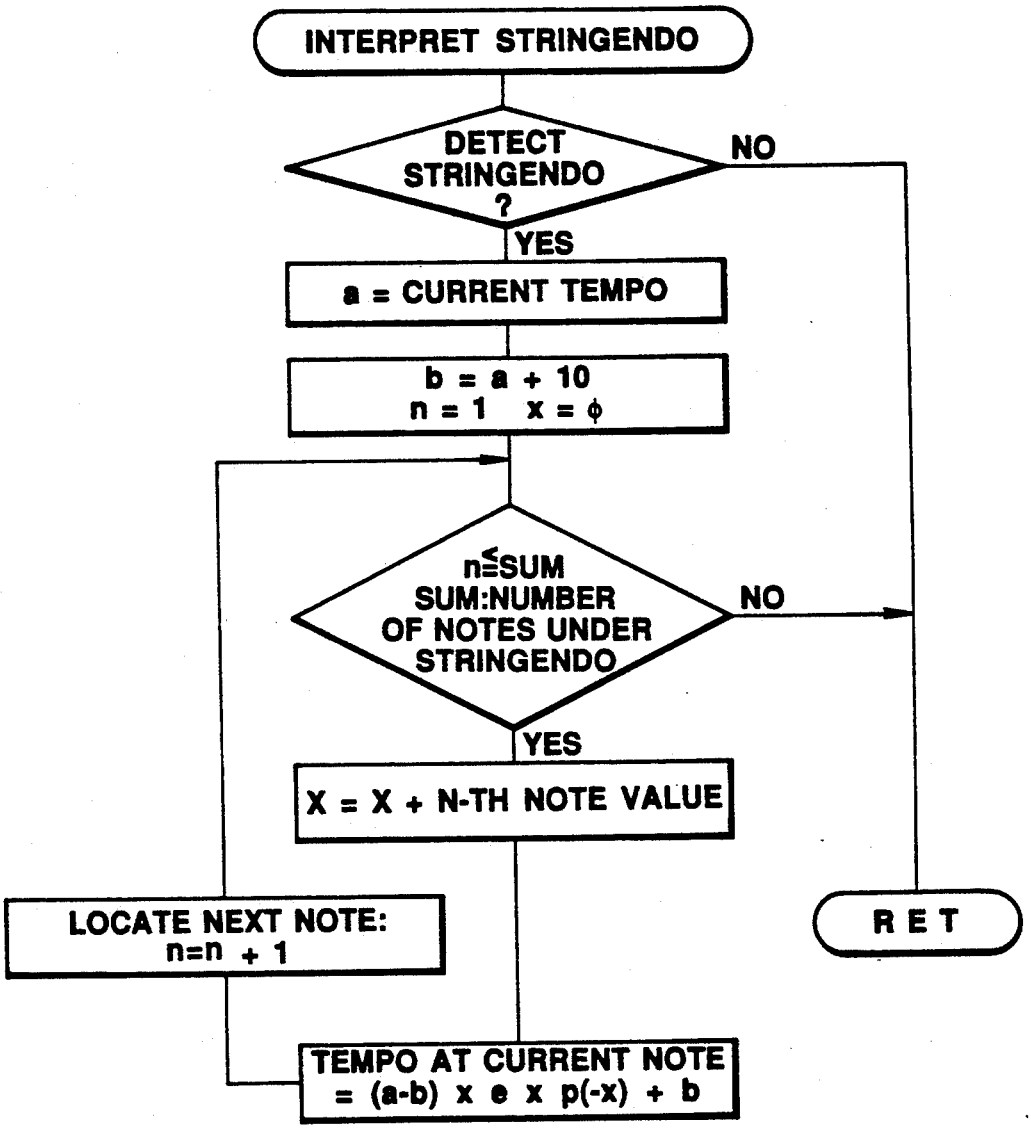
FIG. 31 is a flow chart of an interpret stringendo routine.

FIGS. 29-31 show routines for interpreting the respective tempo gradation marks.

The interpret accelerando routine (FIG. 28) computes a tempo of each note in the accelerando zone by:

$$y=-\log(-x+bb)+a+\log(bb)$$

in which bb indicates a location (accelerando end+100), a indicates a tempo (prevailing tempo) before the accelerando and has been determined by an upper routine (not shown) from the music composition tempo mark written in the declarative block of the ML-G file, and x is a note location in terms of an accumulated time value measured from the accelerando start. According to the function y, the tempo gets faster in the accelerando region.

The interpret ritardando routine (FIG. 30) controls each note in the ritardando zone to be performed at a tempo:

$$y=\log(-x+bb)+a-\log(bb)$$

in which the meaning of factors a, bb x is the same as described with respect to the accelerando. This function y is an upset of the accelerando tempo function with respect to the line y=a. Thus the tempo in the ritardando gradually slows down.

The interpret stringendo routine (FIG. 31) computes the tempo of each individual note in the stringendo region by:

$$y=(a-b)\exp(-x)+b$$

in which a indicates a prevailing tempo before the stringendo and b indicates a tempo limit value and is given by (a+10). Thus, the tempo in the stringendo region gets faster. However, unlike the accelerando, it approaches the tempo limit value b.

In this manner each interpretation routine of tempo gradation mark (FIGS. 29-31) controls the note group associated with a tempo gradation mark such that they are performed at a time varying speed, thus realizing the note group control function described with respect to FIG. 7. In addition, modification of the prevailing tempo such as the one obtained from the interpretation of a tempo symbol at a broader structure level (e.g., tempo symbol of the entire music composition) to obtain a changing tempo in the tempo gradation region realizes the hierarchical control described with respect to FIG. 6A.

The results of each routine of FIGS. 29-31 are temporarily stored into a tempo array of notes. Providing the ML-P language performance symbol string with tempo data of each and every individual note would require an increased amount of storage capacity. This would also require frequent updating of tempo on a note-by-note basis in performing music using such performance symbol string. To avoid these problems, the final process of the present music interpreter multiplies each note durational data (gate time and step time) in the ML-P language performance string by the ratio of the local tempo of each note to the global tempo of the music composition. Thus the resultant performance string has a single tempo data item representing the music composition tempo while any local tempo departures have been integrated into durational parameters of each note.

Interpretation of Note Duration Modifying Symbol (FIGS. 32-36)

Breath, fermata, staccato, staccatissimo, tenuto and the like pertain to a note duration modifying symbol, the primary function of which is to modify (shorten or prolong) a note duration.

Figure 32:
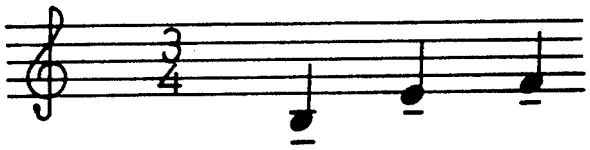
FIG. 32 shows coding of note duration modifying symbols according to ML-G language.
Figure 33:
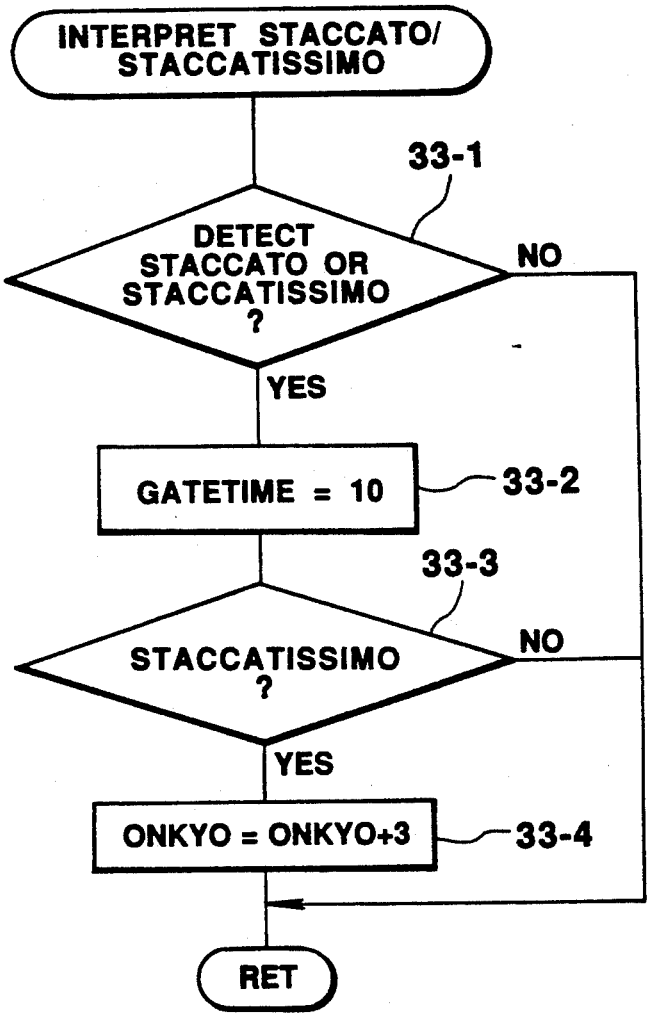
FIG. 33 is a flow chart of an interpret staccato/staccatissimo routine.
Figure 34:
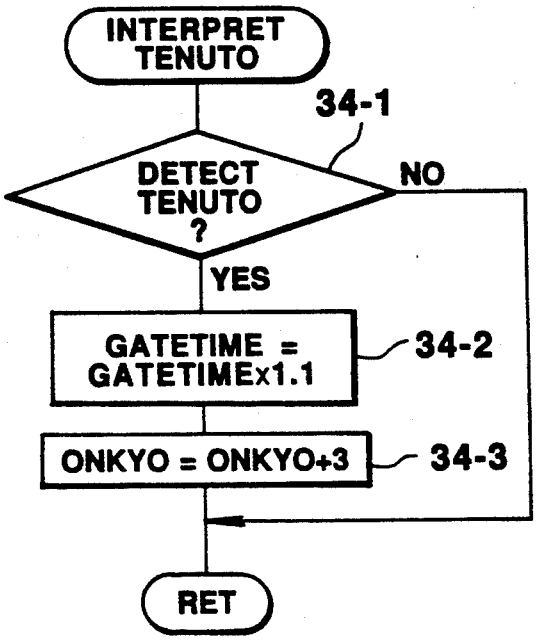
FIG. 34 is a flow chart of an interpret tenuto routine.
Figure 35:
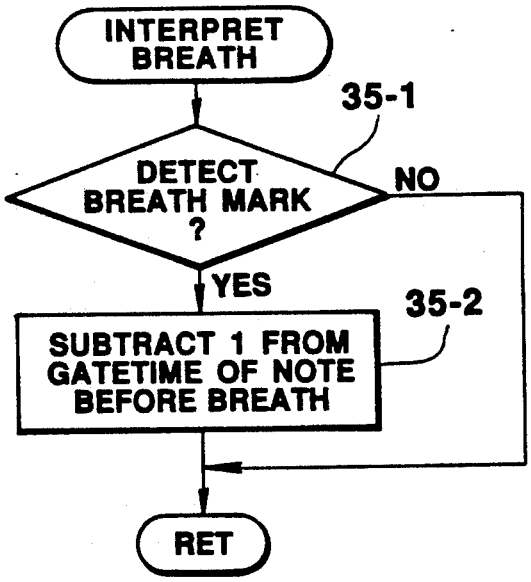
FIG. 35 is a flow chart of an interpret breath routine.
Figure 36:
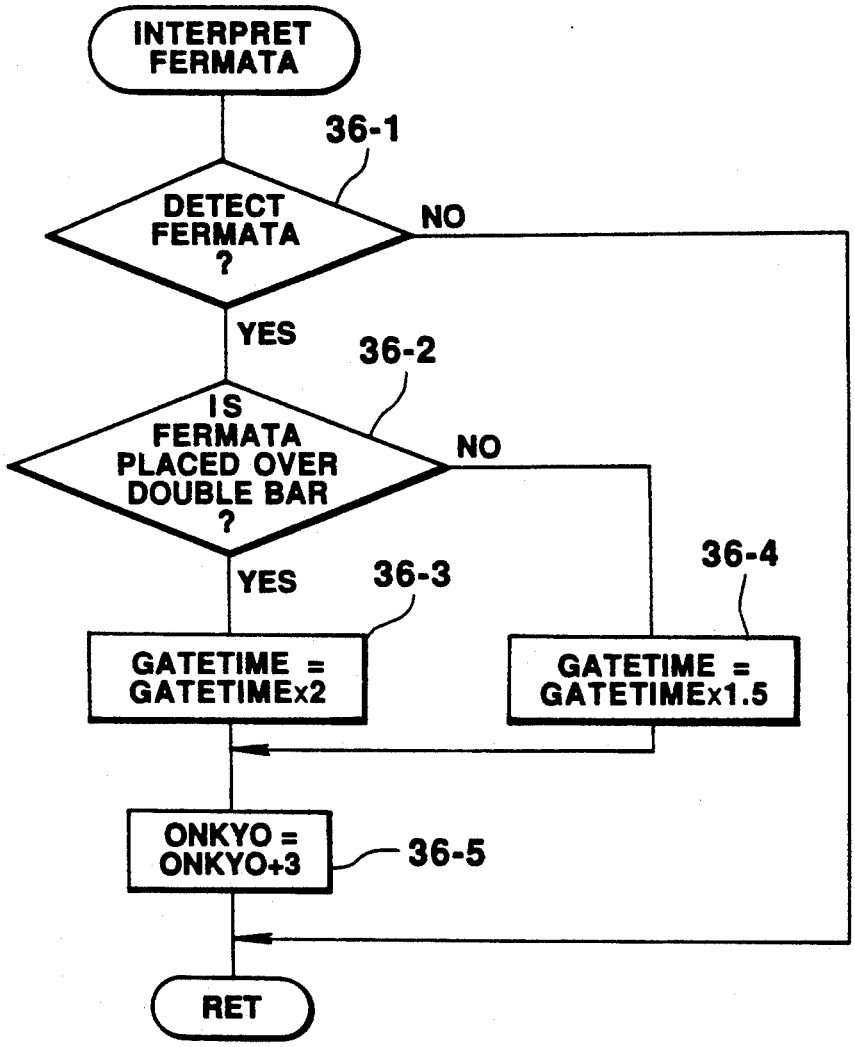
FIG. 36 is a flow chart of an interpret fermata routine.

FIG. 32 shows conventional representation of these symbols in the written music notation along with corresponding representation coded in ML-G language.

FIGS. 33–36 show routines for interpreting respective duration modifying symbols. A feature of these routines (except the breath routine of FIG. 35) is that instead of simply altering the duration of a note only, they modify both the duration and the loudness at the same time, thus realizing the simultaneous duration and loudness control function described with respect to FIG. 8.

Specifically, in the interpret staccato/staccatissimo routine (FIG. 33), if either a staccato ST or staccatissimo symbol SM is detected in the ML-G language coded music notational symbol string (33-1), the gate time (duration) parameter of a note marked with the detected symbol is set to 10 (33-2). Further, the loudness parameter ONKYO of the note is increased by 3 if the detected symbol is a staccatissimo (33-3, 33-4). The loudness parameter before being increased indicates the prevailing loudness previously obtained by an upper routine (the interpret dynamic marks routine or the interpret dynamic gradation routine). Thus, the interpret staccato/staccatissimo routine in combination with the upper routine realizes the hierarchical control shown in FIG. 6A. The same is applied to the routines of FIGS. 34 and 36.

As a result of the interpret staccato/staccatissimo routine (FIG. 33), staccato and staccatissimo notes will be sounded differently in their performance with different loudness levels. The staccatissimo-marked note(s) is (are) played in contrast to its (their) surrounding notes due to its (their) shortened duration (creating a detached sound) and accented loudness.

In the interpret tenuto routine (FIG. 34), if a tenuto symbol TE is detected in the coded music notational symbol string (34-1), the duration parameter (gate time) of the tenuto note in the performance symbol string is multiplied by 1.1 (34-2). Further, the loudness parameter ONKYO of the tenuto note is increased by 3 (34-3). Thus, the tenuto-marked note will be played louder than the surrounding notes without the tenuto.

In the interpret breath routine (FIG. 35) if a breath symbol BR is found in the music notational symbol string (35-1), the duration parameter (gate time) of a note before the breath symbol is shortened by 1 (35-2). This will give a pause of breath or silence, making clear a phrase of notes preceding the breath symbol.

The interpret fermata routine (FIG. 36) interprets a fermata symbol FE (detected in 36-1) differently depending on whether it is placed over a double bar (36-2) or not. In the affirmative, the duration parameter (gate time) of the fermata-marked note is doubled (36-3). Otherwise, it is multiplied by 1.5 (36-4). Further, the loudness parameter ONKYO of the fermata-marked note is increased by 3 (36-5). The above interpretation of a fermata placed over a double bar makes clear the end of a music composition or a section of it.

Interpretation of Multiplet (FIGS. 37–42)

Figure 37:
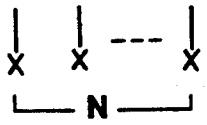
FIG. 37 shows written music notation of a multiplet (a plurality of notes of equal time value which is different from the notated note value specified by the note symbol per se)
Figure 37:
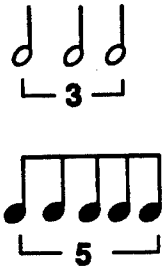

A music notational symbol shown in FIG. 37 represents a multiplet. "Multiplet" refers to a plurality of notes (multiplet note members) of equal time value. However, the actual duration of each multiplet member note is different from the notated value specified by the note symbol itself.

Figure 38:
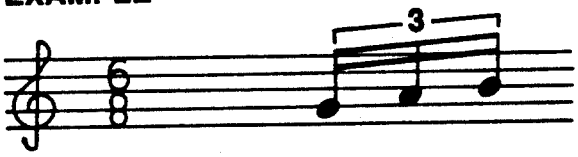
FIG. 38 shows coding of a multiplet according to ML-G language.

FIG. 38 shows coding of the multiplet in ML-G language. The example in FIG. 38 is a triplet which is represented by <3 G4:16-A4:16-B4:16> in ML-G language. G4, A4 and B4 are triplet note members. The number "16" is the notated time value of each member note, which is a sixteenth. In performance, the triplet is played in the time occupied by two notes of the notated time value. Thus, two-thirds of the notated time value ($\frac{2}{3}\times$sixteenth) is the actual time value of each member note.

In general, each member note of a multiplet has an equal time value which is, thus, determined by dividing the whole duration of the multiplet by the number of members constituting the multiplet. Therefore, the whole duration of the multiplet, which depends on musical context, must be determined to specify each individual member duration.

FIG. 39 shows coefficients for converting a notated time value of a multiplet member note to its actual duration with respect to several values of the whole duration of multiplets. The actual time value of a multiplet member note is obtained by multiplying its notated time value by an appropriate coefficient in FIG. 39.

Figure 40:
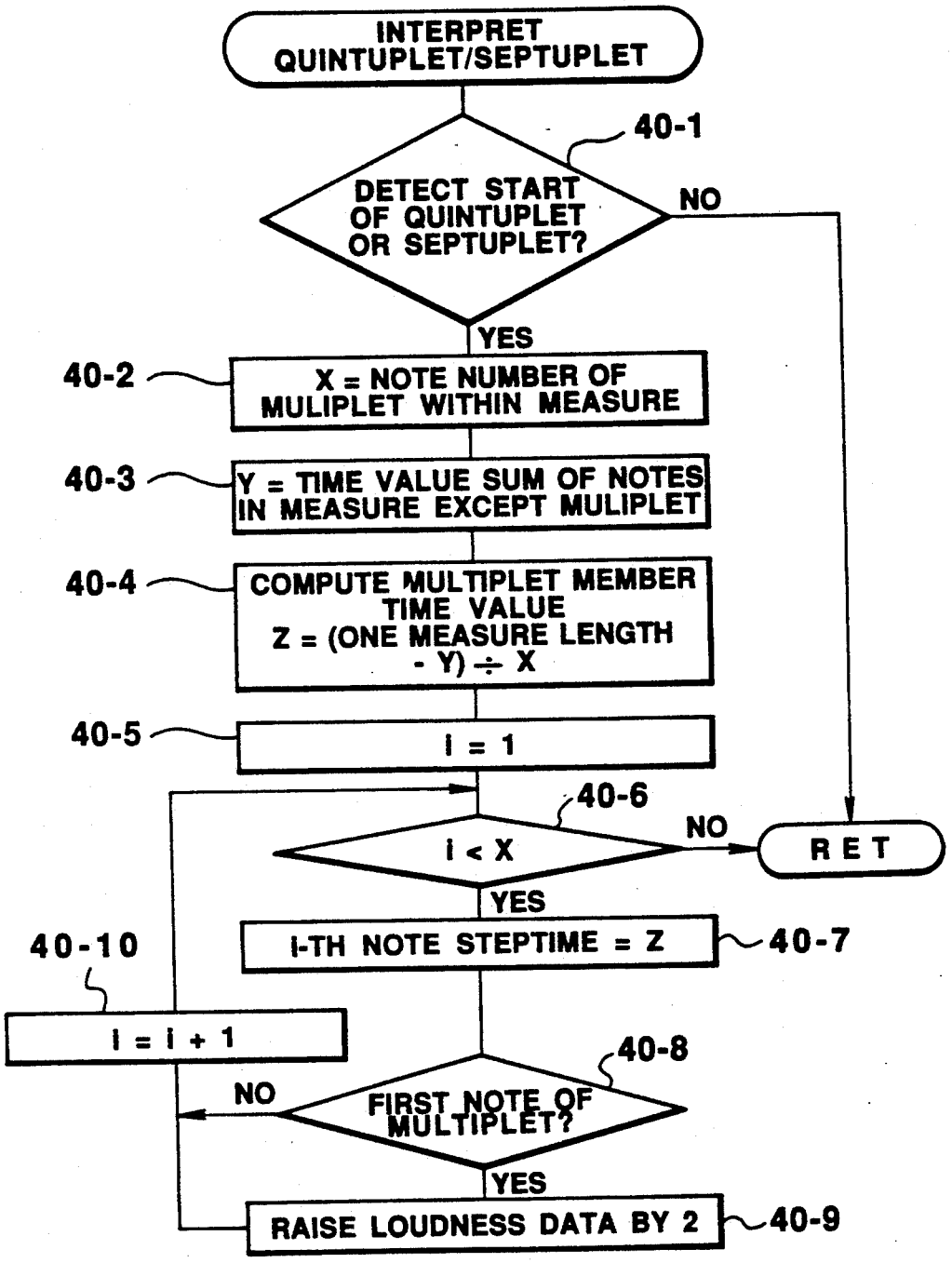
FIG. 40 is a flow chart of an interpret quintuplet/septuplet routine.
Figure 41:
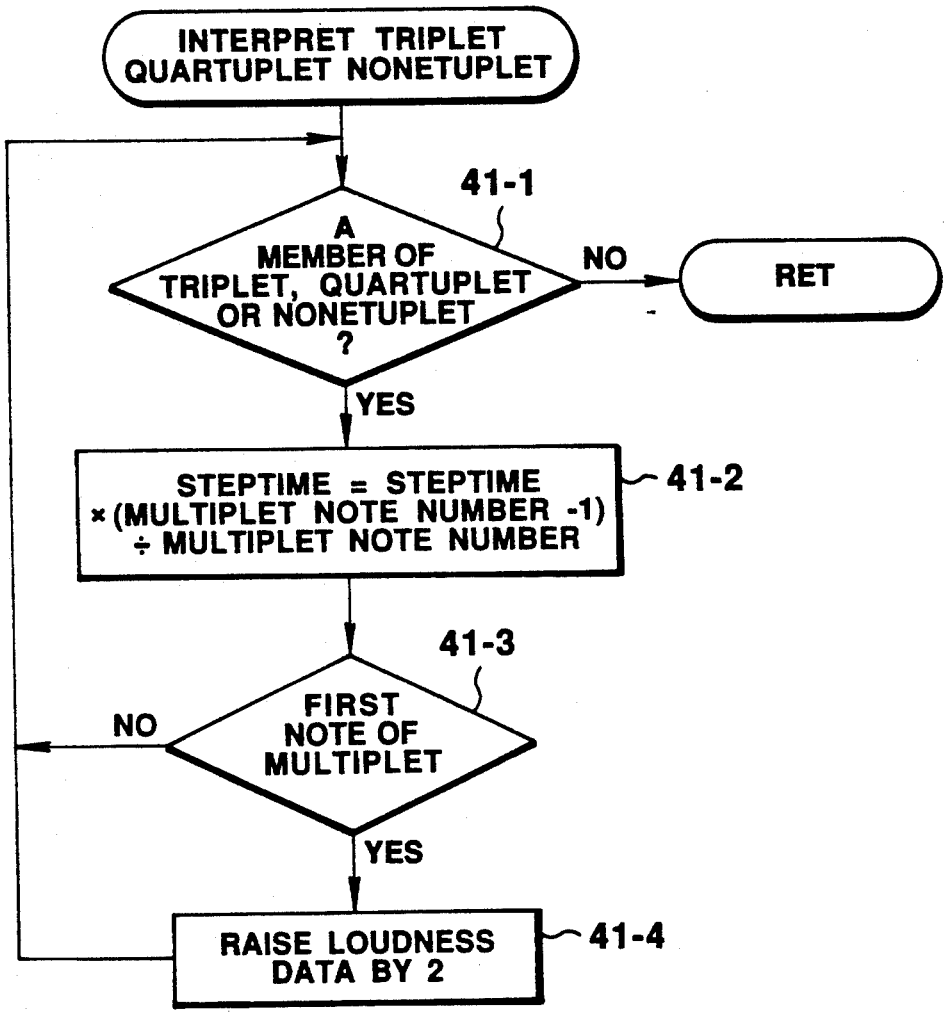
FIG. 41 is a flow chart of an interpret triplet, quartuplet and nonetuplet.
Figure 42:
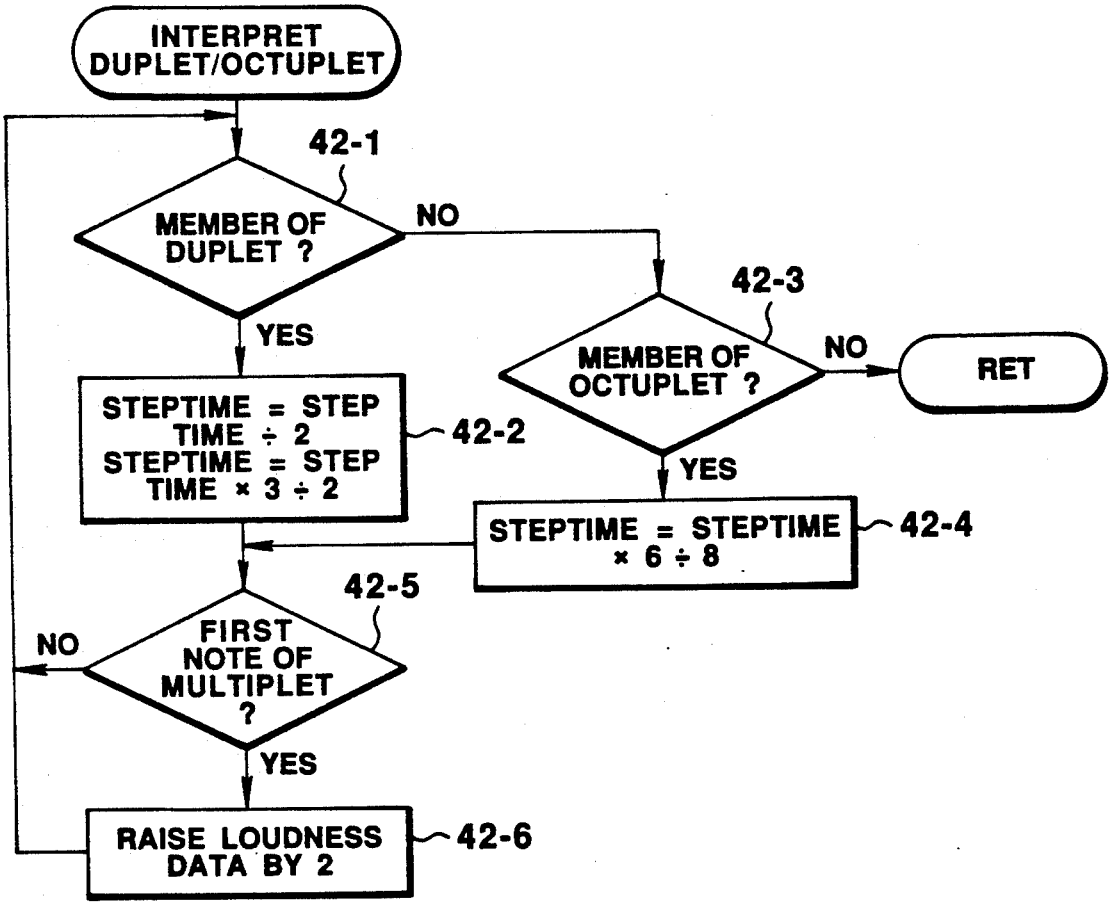
FIG. 42 is a flow chart of an interpret duplet/octuplet routine.

FIGS. 40–42 show routines for interpreting respective multiplets. A feature of these routines is to correct a notated time value of multiplet member note for performance according to the coefficient table of FIG. 39 or by the context analysis and to raise the loudness of the first note in the multiplet relative to the other multiplet members. Thus, these routines have the note group control function (FIG. 7) and the simultaneous duration and loudness control function (FIG. 8). In addition, the loudness of the first note in the multiplet is computed based on prevailing loudness having been obtained from the interpretation of a prevailing dynamic symbol at a broader level in the hierarchical music structure by increasing the prevailing loudness by a predetermined amount. This feature realizes the hierarchical control described with respect to FIG. 6A.

Each multiplet interpreting routine (FIGS. 40–42) computes the loudness of the first note in the multiplet by increasing the prevailing loudness i.e., the interpretation value of a prevailing dynamic mark at a broader level in hierarchy of music by 2 (see steps 40-9, 41-4 and 42-6).

To obtain the actual time value of a multiplet member note, the interpret quintuplet/septuplet routine of FIG. 40, which comprises steps 40-1 to 40-10 as shown, first determines the entire time value of the multiplet, here, quintuplet or septuplet by subtracting the time value of non-multiplet notes in the measure containing the multiplet from one measure length (40-1 to 40-4). Then the entire duration of the multiplet thus determined is divided by the number of multiplet members (5 for quintuplet, 7 for septuplet) to obtain the actual time value of a multiplet member note (40-4). The actual time value is set into the step time of each multiplet member note in the ML-P language performance symbol string (40-7 in the loop 40-6 to 40-10).

The interpret triplet/quintuplet/nonetuplet routine of FIG. 41, which comprises step 41-1 to 41-4, corrects the step time of each multiplet member note having been set to its notated time value written in the ML-G language music notational symbol string by multiplying it by {(number of multiplet member notes − 1) ÷ (number of multiplet member notes)} i.e., a corresponding coefficient in FIG. 39 to obtain the actual step time (41-1, 41-2).

The interpret duplet/octuplet routine of FIG. 42, which comprises steps 42-1 to 42-6, corrects the step time of each multiplet member note having been set to its notated time value written in the ML-G language music notational symbol string by multiplying it by $\frac{3}{4}$ for duplet, 6/8 for octuplet in accordance with the coefficient table of FIG. 39 to obtain the correct-valued step time parameter in the ML-P language performance symbol string (42-1, 42-2; 42-3, 42-4).

Interpretation of Appoggiatura (FIGS. 43–49)

Figure 43:
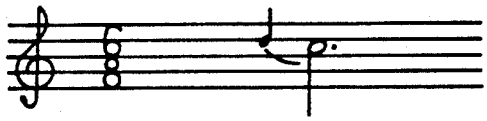
FIG. 43 shows coding of appoggiatura according to ML-G language.

FIG. 43 shows, as species of appoggiatura, symbols of acciaccatura, double appoggiatura and long appoggiatura, each coded in ML-G language. The note ornamented by appoggiatura (ornamenting note) is commonly called the main note. In the example of FIG. 43, a C5 note having a notated time value of a dotted half note (i.e., 1.5×half note or value of three quarter notes) is the main note. In performance, however, the main note C5 is not played in the time of the notated value, but is shortened such that the dotted half note value is occupied by the duration sum of the appoggiatura, here D5, and the main note C5. Since ML-G language describes a note time value as notated in a written music, converting of the notated time value is required for performance realization.

Figure 45:
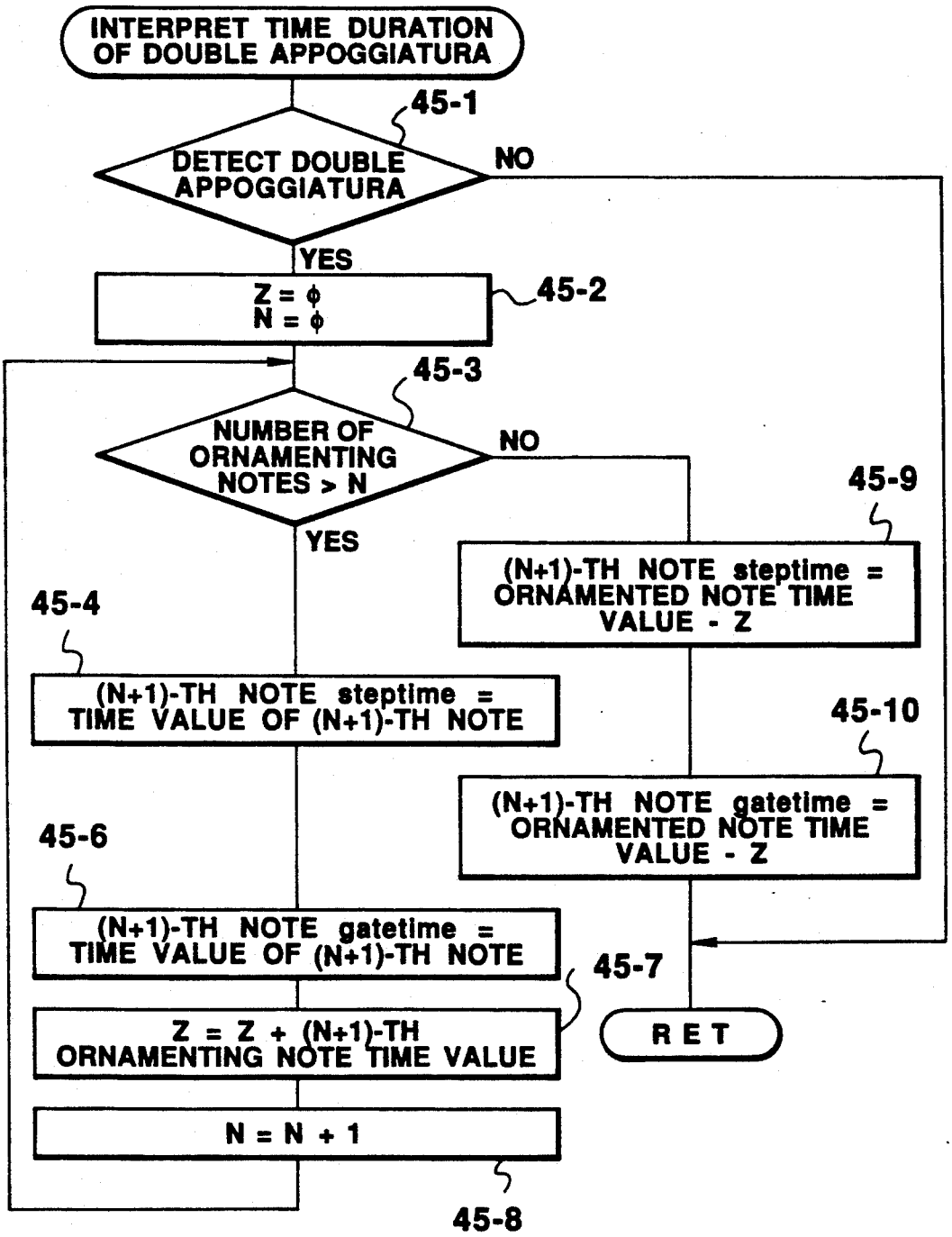
FIG. 45 is a flow chart of an interpret time duration of double appoggiatura routine.
Figure 46:
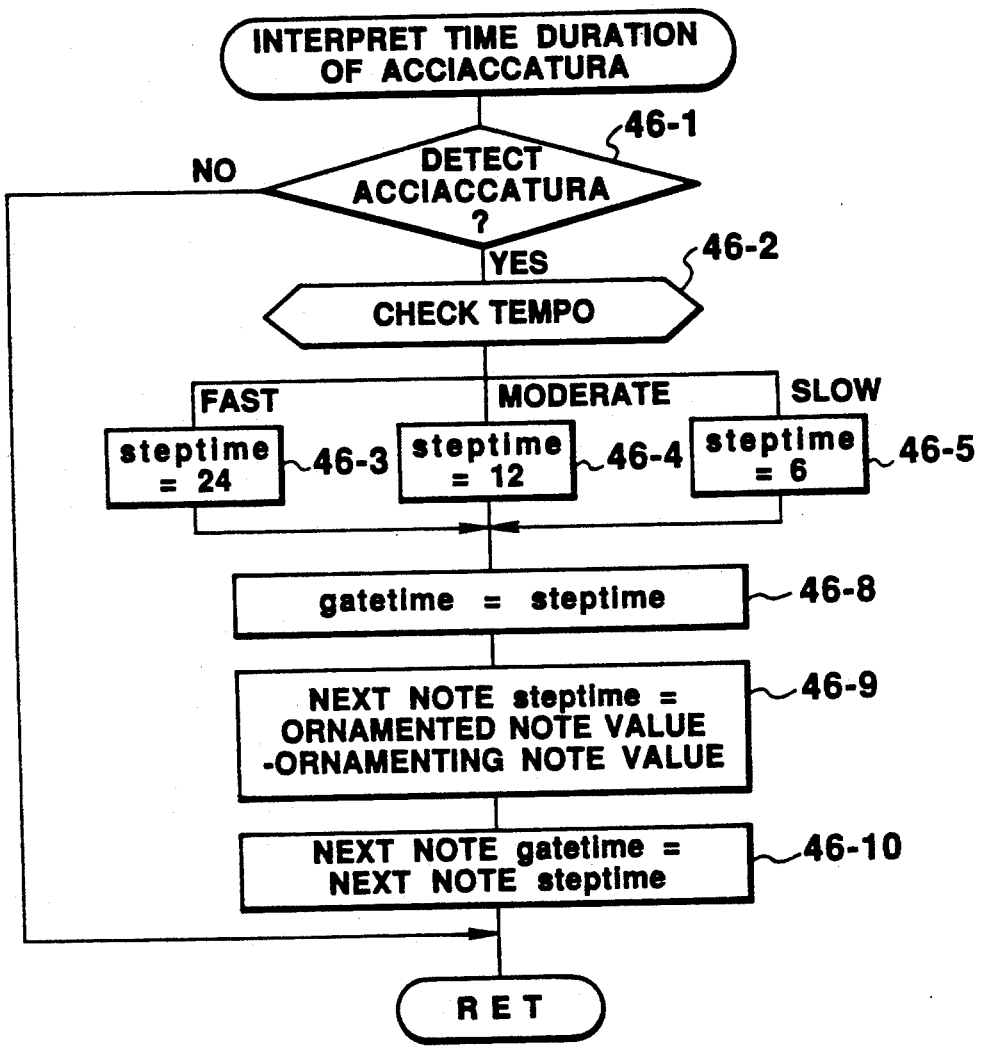
FIG. 46 is a flow chart of an interpret time duration of acciaccatura routine.
Figure 47:
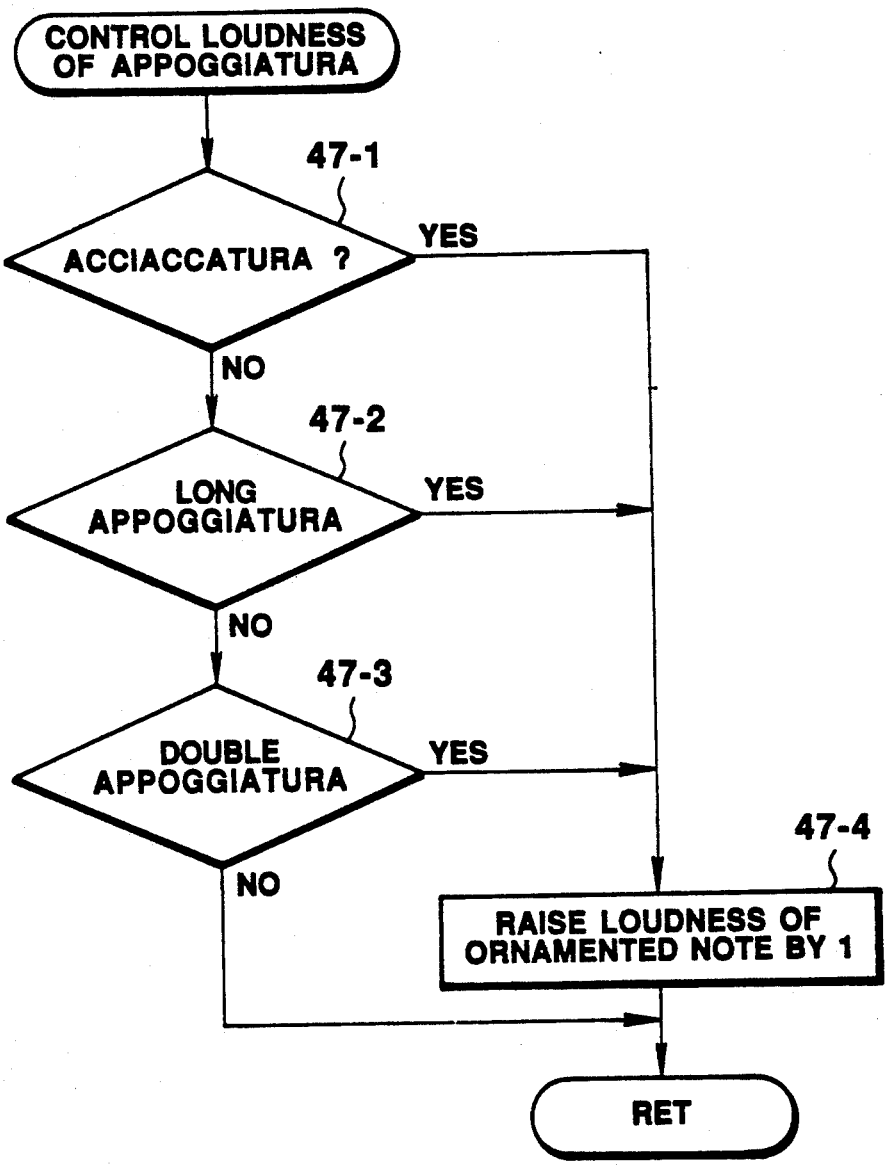
FIG. 47 is a flow chart of a routine for controlling loudness of appoggiatura which includes, as species, acciaccatura, long appoggiatura and double appoggiatura.

To this end, the respective appoggiatura interpreting routines in FIGS. 44–47 correct the notated time values of appoggiatura note and main note from the ML-G language coded music notational symbol string such that these notes are played in correct durations. In addition, the appoggiatura interpretation includes a process of lightly accenting the main note to make explicit the nature of the main note (FIG. 47). Thus, the main note is controlled with respect to both duration and loudness by the simultaneous control function such as the one described in connection with FIG. 8. The loudness of the main note is specified by combining prevailing loudness (i.e., extensive interpretation value of a dynamic mark prevailing over the main and surrounding notes) with a local loudness difference value of 1 (47-1 to 47-4), thus realizing the hierarchical control of FIG. 6A with respect to loudness.

Figure 44:
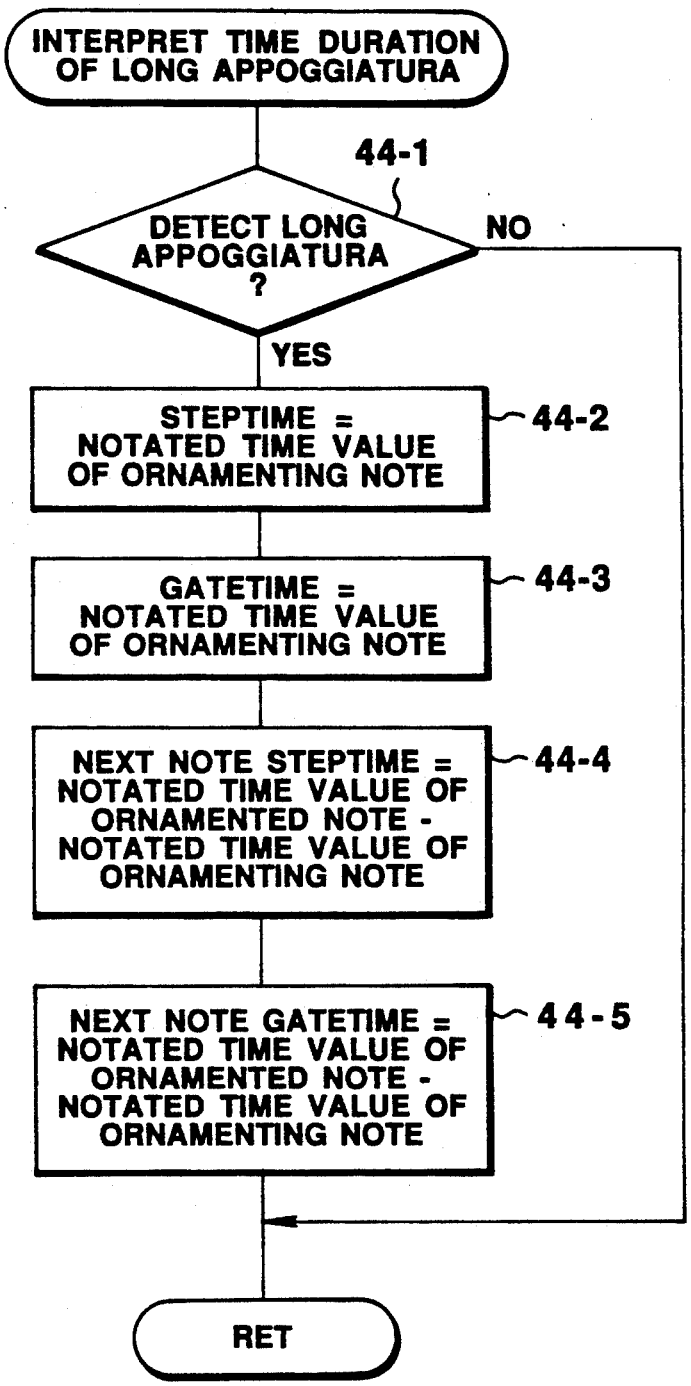
FIG. 44 is a flow chart of an interpret time duration of long appoggiatura routine.

In FIG. 44, when it detects a long appoggiatura symbol L& in the music notational symbol string (44-1), the interpret duration of long appoggiatura routine sets the step time and gate time parameters of the long appoggiatura note in the performance symbol string to the notated time value of the long appoggiatura in the music notational symbol string, specifically, its equivalence in ML-P language durational representation which is obtained by the ML-G to ML-P durational conversion shown in FIG. 3 (44-2, 44-3). Then the routine corrects the step time and gate time of the main note (note coming after the long appoggiatura) in the ML-P language performance symbol string by subtracting the notated time value of the long appoggiatura from the notated time value of the main note (44-4, 44-5).

Figure 48:
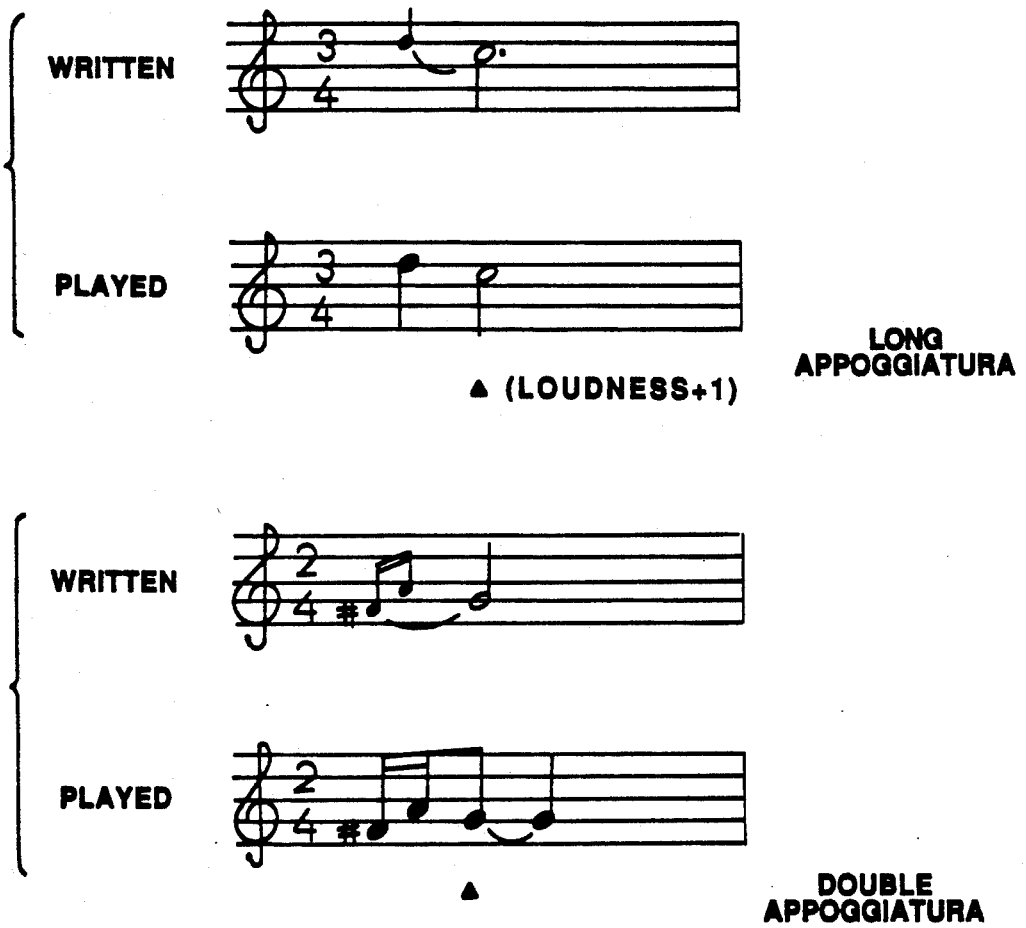
FIG. 48 shows staves illustrating how long and double appoggiaturas are interpreted.

As example of the interpretation provided by the routine of FIG. 44 is shown in the upper two staves in FIG. 48. The "written" or top staff containing a long appoggiatura note and a main note may be represented in the ML-G language music notational symbol string. The "played" or second staff is represented in the ML-P language performance symbol string after the long appoggiatura interpretation.

In FIG. 45, when detecting a double appoggiatura symbol D& in the music notational symbol string (45-1), the interpret time duration of double appoggiatura routine sets the step time and gate time parameters of each ornamenting note (constituting the double appoggiatura) in the music notational symbol string to the (ML-P coded) notated time value thereof (45-2 to 45-8). Then the routine corrects the step time and gate time parameters of the main note (ornamented by the double appoggiatura) by subtracting the durational sum or step time sum Z of the ornamenting notes from the notated time value of the main note (45-9, 45-10).

The double appoggiatura interpretation is exemplified in the lower two staves of FIG. 48 for the double appoggiatura having two ornamenting notes.

In FIG. 46, after detecting an acciaccatura symbol A& in the coded music notational symbol string (46-1), the interpret duration of acciaccatura routine checks the tempo of music composition (46-2). If the tempo is fast, the routine sets the step time and gate time parameters of the acciaccatura note to 24 equivalent to a sixteenth note (46-3, 46-8). For moderate tempo, the routine sets them to 12 corresponding to a thirty-second note (46-4, 46-8). For slow tempo, the routine sets them to 6 so that the acciaccatura note will be played as a sixty-fourth valued note (46-5, 46-8). Then the routine corrects the step time and gate time parameters i.e., played durational parameters of the main note by subtracting the played acciaccatura note duration specified by its step time from the (ML-P coded) notated time value of the main note (46-9, 46-10).

In this manner, the interpret duration of acciaccatura routine provides different realizations of acciaccatura performance depending on tempo.

Figure 49:
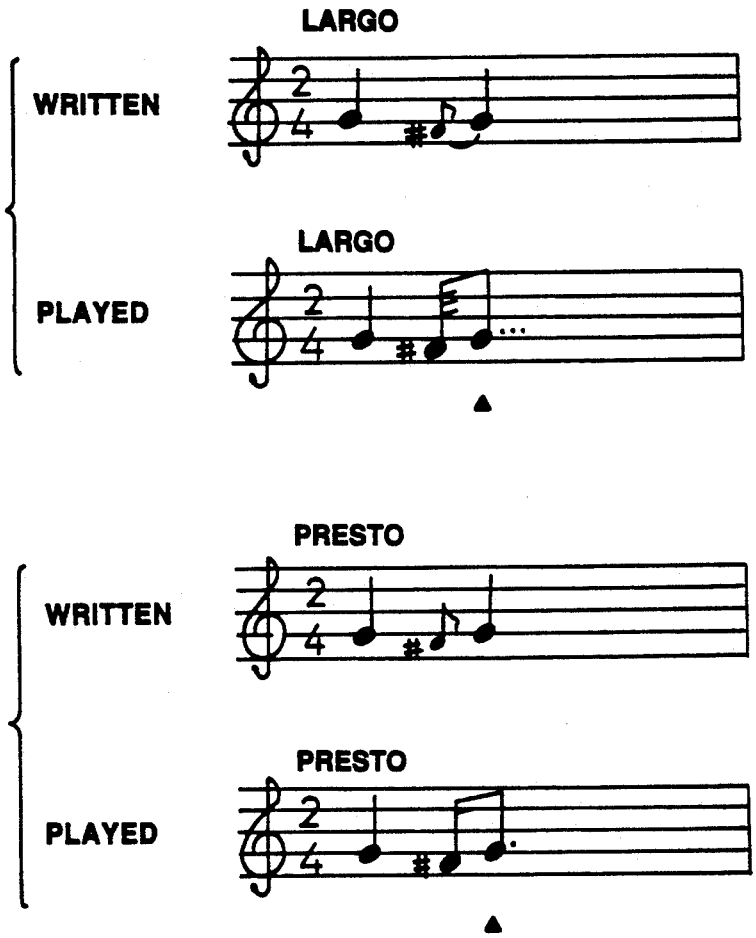
FIG. 49 shows staves illustrating different interpretations of acciaccatura depending on tempo.
Figure 50:
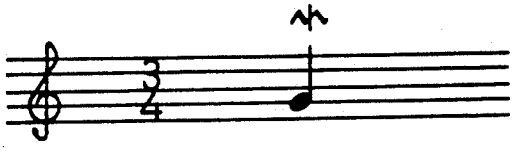
FIG. 50 shows coding of ornament symbols according to ML-G language.

An example is shown in FIG. 49 in which the top and third "written" staves have the same notation of melody (G-F#-G) with each other. However, the top staff music is indicated to be performed at largo tempo i.e., slow tempo while the third staff music is marked to be performed at presto tempo i.e., fast tempo. As a result of the routine in FIG. 46, the top "written" music is played as shown in the second "played" staff while the third "written" music is differently played as shown in the bottom "played" staff although their melody notation is identical.

Interpretation of Ornament Symbol (FIGS. 50–53)

Mordent, pralltriller (inverted mordent), trill, turn, inverted turn etc., pertain to musical ornament using adjacent pitches. Symbols of these ornaments are coded to MO (for mordent), PR (for pralltriller), TR (for trill), TU (for turn) and IT (for inverted turn) in ML-G language. The music notation of a written music composition does not express individual ornamental notes but simply indicates an ornament symbol placed over or under the main note (G4 in the example of FIG. 50), or between notes. Therefore, the ML-G language coded music notational symbol string (ML-G string) representing the written music also fails to contain symbols of individual ornamental notes.

In view of this, the present music interpreter apparatus has a function of interpreting an ornament symbol into required performance realization containing individual ornament note members with specified pitches and durations. In addition, the ornament interpreting function provides a dynamic in the note group forming the ornament pattern by lightly accenting an important note (e.g., the first note) in the ornament pattern. These features realize the note group control (FIG. 7), the simultaneous control of duration and loudness (FIG. 8) and hierarchical control (FIG. 6A) of loudness.

Let us take up the interpretation of turn as an ornament example. Turn is interpreted in accordance with the routine shown in FIGS. 51-53. The illustrated routine uses a turn ornament pattern which is made up of four note members of equal time value and which begins with an upper neighbor note, followed by the main note, a lower neighbor note and returning to the main note.

Figure 51:
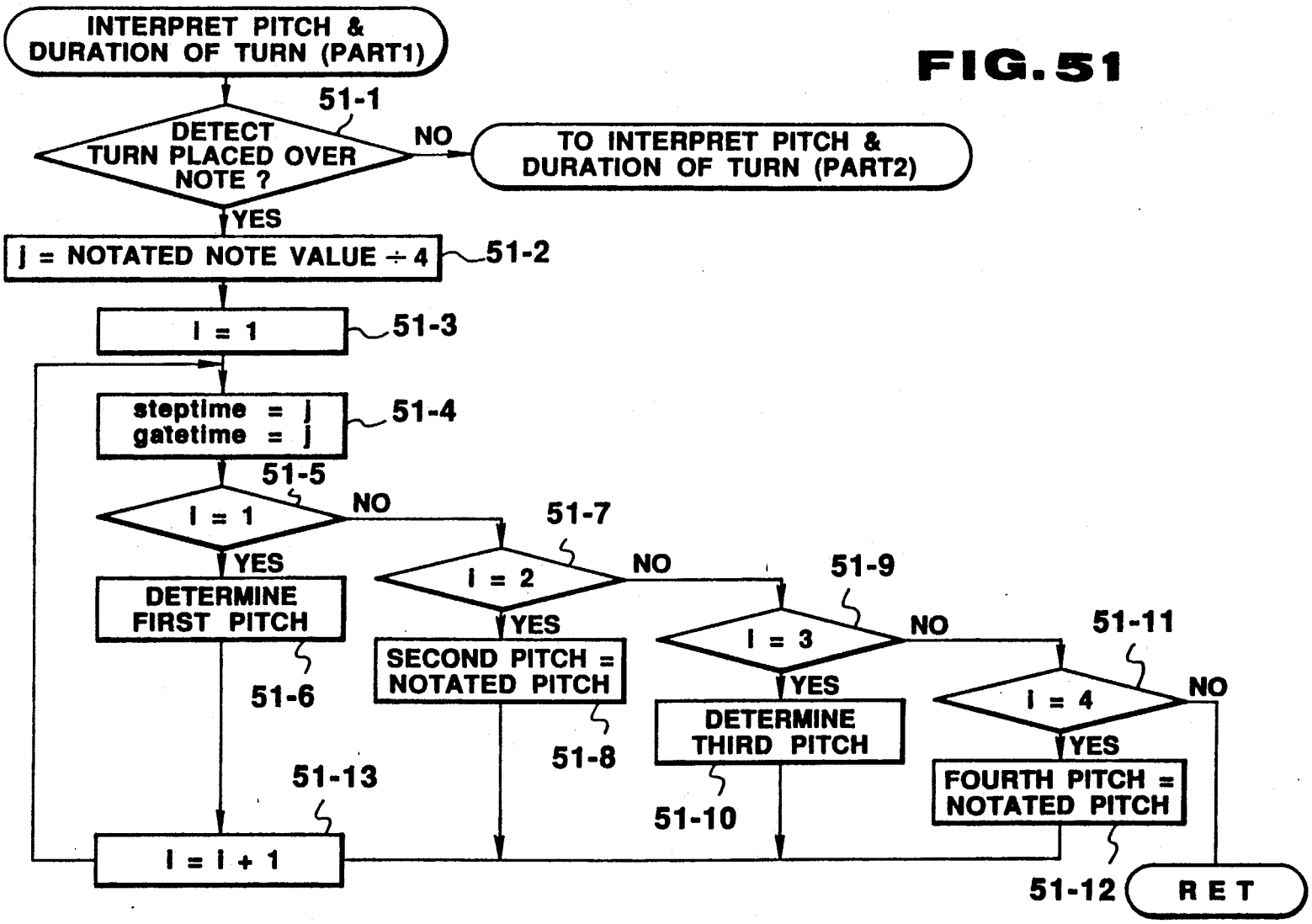
FIG. 51 is a flow chart showing a first part of an interpret pitch and duration of turn (species of ornament) routine.

In FIG. 51, when it detects a turn symbol TU placed over a note in the music notational symbol string (51-1), the routine divides the (ML-P coded) notated time value of the turn-marked note by 4 to specify the step time and gate time parameters of each turn note member (51-2 to 51-4) in the ML-P language coded music performance symbol string (ML-P string). Further, in steps 51-5 to 51-13, pitch of each turn note member (in ML-P string) is determined such that the second and fourth notes have the main note pitch notated by the pitch of the turn-marked note, the first note has a pitch of one step above the main note and the third note has a pitch of one step below the main note.

Figure 52:
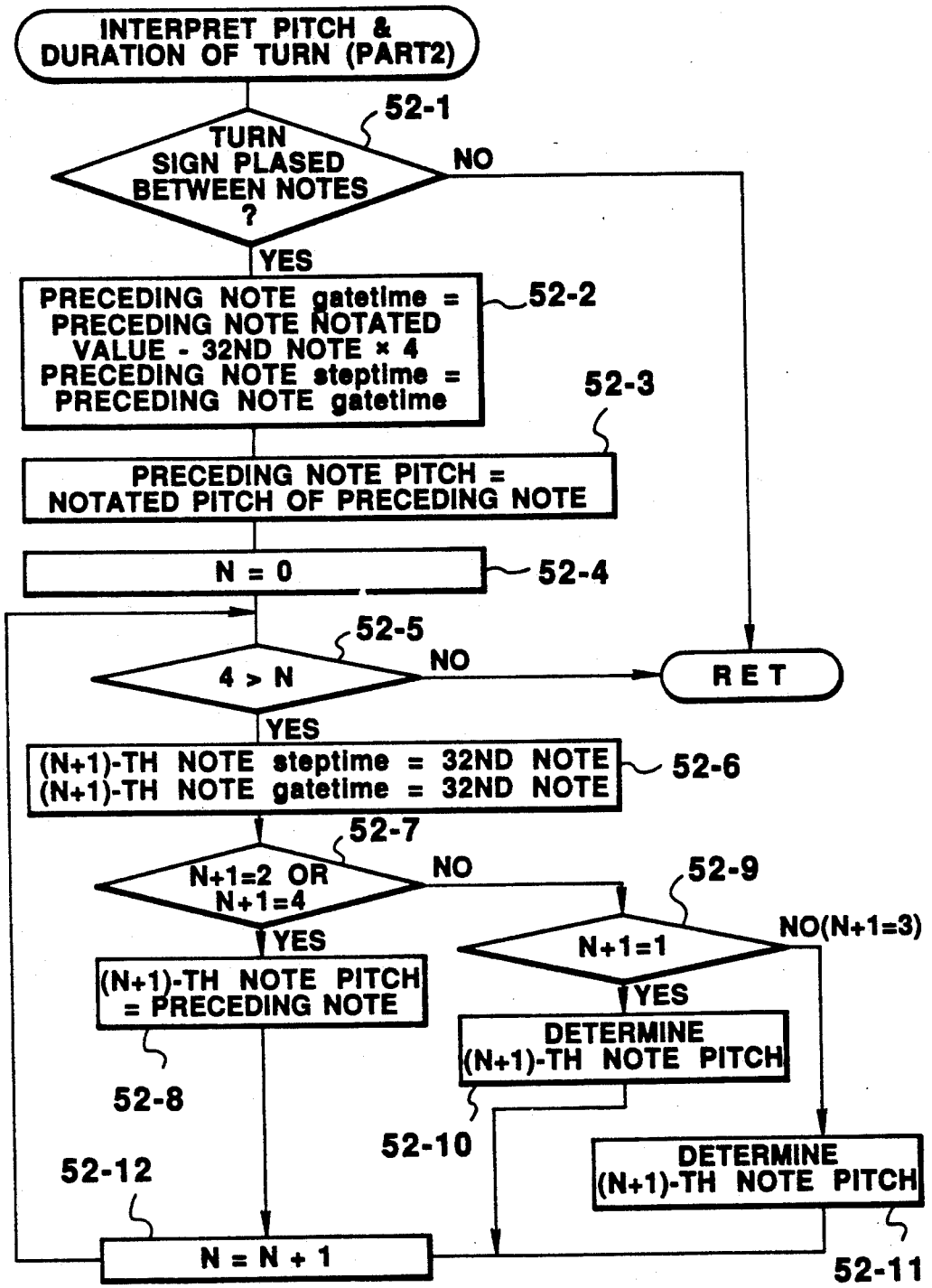
FIG. 52 is a flow chart showing a second part of the interpret pitch and duration of turn routine.

In FIG. 52, if a turn symbol TU placed between notes is found in the music notational symbol string (52-1), step time and gate time parameters of each turn note member are set equal to 12 corresponding to a thirty-second note (52-6). To obtain the played duration of a note in front of the turn symbol (preceding note), step time and gate time parameters of the preceding note in the ML-P language coded performance symbol string are set by subtracting four thirty-second notes (whole duration of the turn ornament pattern) from the notated time value of the preceding note in the music notational symbol string (52-2). The preceding note pitch parameter in ML-P string is set equal to its notated pitch in ML-G string (52-3). Steps 52-5 to 52-12 determine the pitch of each turn note member in the same manner as the steps 51-5 to 51-13 in FIG. 51.

Figure 53:
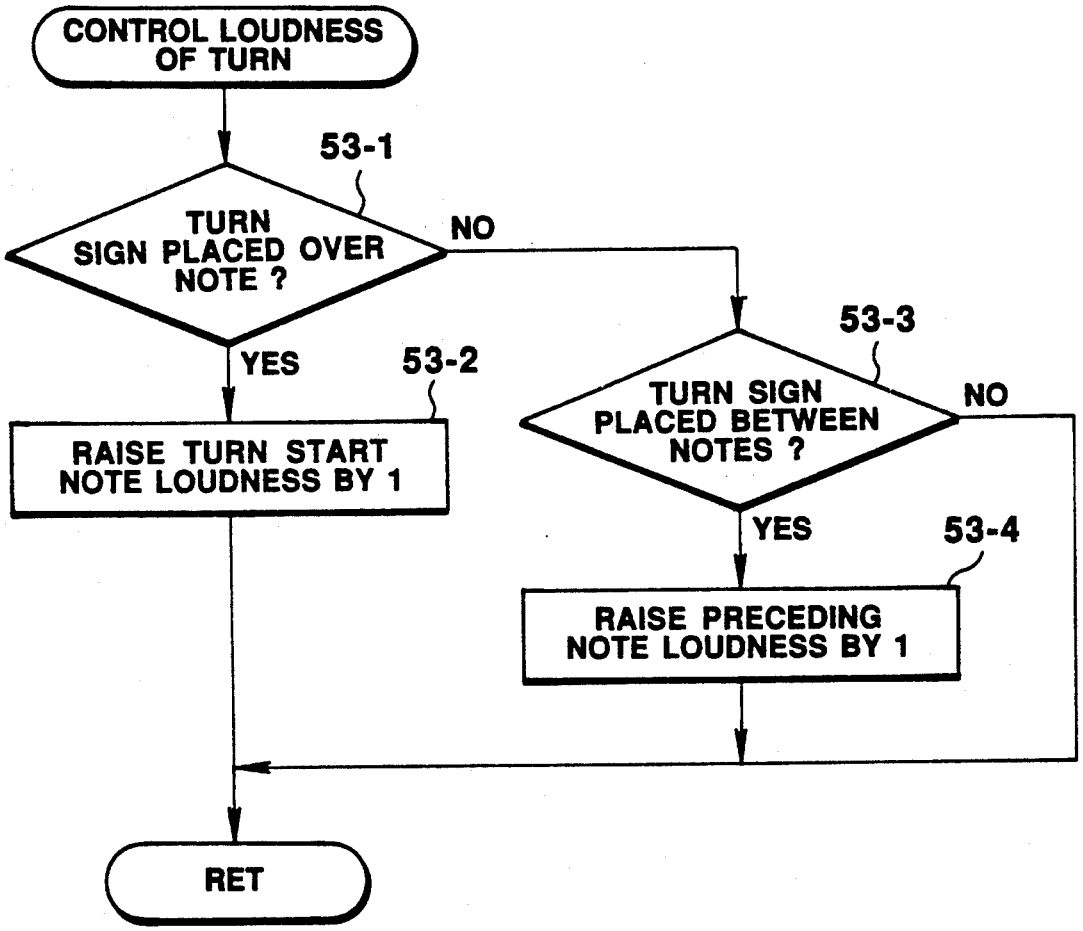
FIG. 53 is a flow chart of a control loudness of turn routine.

In the control loudness of turn routine in FIG. 53, if a turn symbol or sign is placed over a (main) note (53-1), the first note in the turn ornament pattern is lightly accented by increasing its loudness parameter by 1 (53-2). The loudness parameter was previously set to the prevailing loudness obtained from the interpretation of a hierarchically broader dynamic mark prevailing over the turn-marked note and surrounding notes. If the turn sign is placed between notes (53-3), the note in front of the turn sign (preceding note) is lightly accented by increasing its loudness parameter in ML-P string by 1 (53-4).

Figure 54:
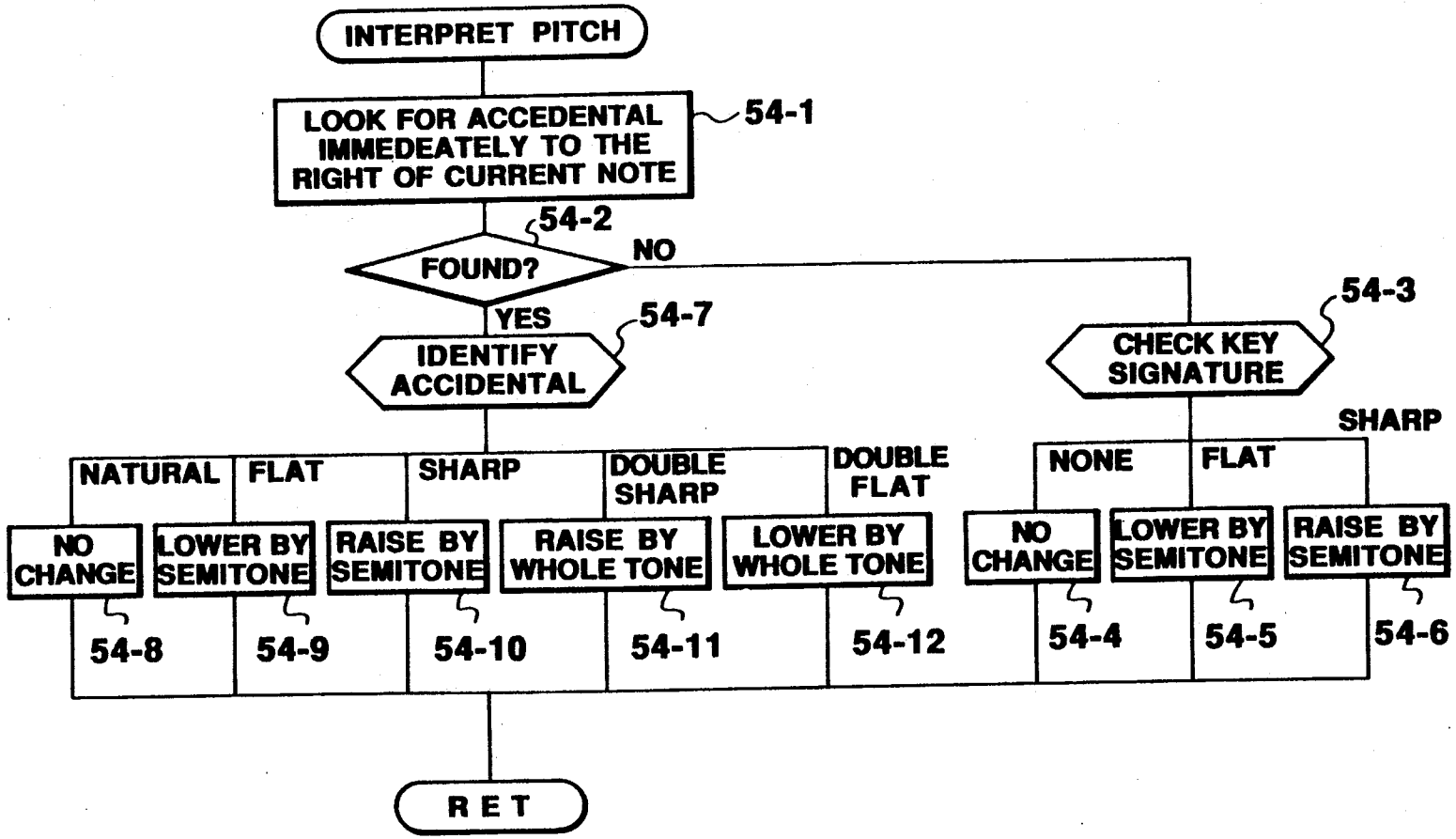
FIG. 54 is a flow chart of an interpret pitch routine.
Figure 55:
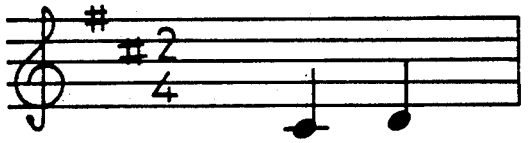
FIG. 55 shows staves together with pitch interpretation of notes.
Figure 55:
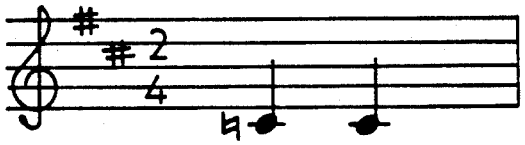
Figure 55:
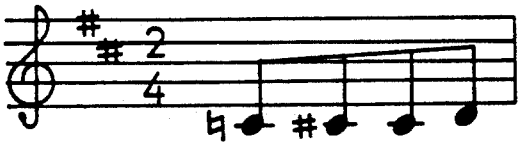

Pitch Interpretation (FIGS. 54 and 55)

FIG. 54 shows an interpret pitch routine. The first step 54-1 looks through a measure containing a current note in the music notational symbol string (ML-G string) for an accidental symbol immediately to the right of the current note. If no such accidental is found (54-2), the routine executes step 54-3 to check the key signature in order to determine the pitch of the current note from the key signature interpretation. Specifically, if the key signature has no pitch modifying symbol (sharp or flat) with respect to the horizontal position of the current note, the notated pitch of the current note in ML-G string is used as the actually played pitch in ML-P string (54-4). If the key signature has a flat for the current note horizontal position, the notated pitch of the current note from the ML-G string is lowered by one semitone to specify the actual pitch in ML-P string (54-5). If the key signature contains a sharp sign for the current note horizontal position, the notated pitch of the current note is raised by one semitone to obtain the played pitch of the current note in the performance symbol ML-P string.

In this manner, in the absence of an accidental (i.e., local symbol of pitch modification), the played pitch of a note is determined based on the interpretation of a key signature (i.e., extensive symbol of pitch modification).

On the other hand, if an accidental symbol is marked for the current note, the routine executes step 54-7 to identify (interpret) the accidental in order to determine the current note pitch by using the interpretation of the accidental. If the accidental is natural, the notated pitch of the current note in ML-G string is directly used as the actual pitch of the current note in ML-P string (54-8). If the accidental is flat, the notated pitch is lowered by one semitone to obtain the actual pitch of the current note (54-9). If the accidental is a sharp, the notated pitch is raised by one semitone to determine the actual pitch of the current note in ML-P string (54-10). If the accidental is double sharp, the actual pitch of the current note is specified by two semitones above the notated pitch (54-11). For a double flat accidental, the actual or played pitch of the current note is determined by two semitones below the notated pitch (54-12).

In this manner, the interpret pitch routine realizes the hierarchical control of pitch described with respect to FIG. 6B.

As a result, note pitches are correctly interpreted as illustrated in FIG. 55.

In FIG. 55, the key signature denotes a key of D major, indicating a raising by one semitone of pitches F and C. The top staff contains two notes having notated pitches C and D, respectively. No accidental is associated with these notes. Thus, the pitch interpreting routine of FIG. 54 interprets the C and D notes as being played as C#-D by using the extensive interpretation of the key signature. The middle staff contains two notes having the same notated pitch C. These notes are marked by a natural accidental. Thus, selecting the local interpretation of the natural accidental, the pitch interpreting routine interprets the notated C-C notes to be played as C-C. The bottom staff contains four notes with notated pitches C, C, C and D, respectively. The first note of notated pitch C is marked by a natural accidental. The second and third notes of notated pitch C are marked by or associated with a sharp accidental. Thus, the pitch interpreting routine of FIG. 54 selects the interpretation of the corresponding accidentals for the first to third note and selects the interpretation of the key signature for the fourth note of notated pitch D so that the notated notes of C-C-C-D are played as C-C#-C#-D.

This concludes the detailed description of the invention with respect to the preferred embodiments. However, various modifications and applications are obvious by a person of ordinary skill in the art, falling well within the scope of the invention. For example, ML-G language for describing a written music composition and ML-P language for describing performance of composition are illustrative only. Any other suitable computer language for describing (coding) a written music or music notation, or for describing (coding) a performed music may be employed.

Therefore, the scope and spirit of the invention is solely defined by the appended claims and their eqivalents.

APPENDIX

ML-G FILE EXAMPLE

```
%score
/*
 * Title    : PROMENADE (TABLEAUX D'UN EXPOSITION)
 * Composer: M. P. Mussorgsky
 *
 */

tempo(Allegro) dynamics(f)
%staff
key(b2) clef(G) beat(5/4)
%part
G4:4(TE) F4:4(TE) B4:4(TE) C5:8-(bSL,TE)
F5:8(eSL) D5:4(TE) |
beat(6/4) C5:8-(bSL,TE) F5:8(TE) D5:4(eSL,TE)
B4:4(TE) C5:4(TE) G4:4(TE) F4:4(TE) |
beat(5/4) B3^D4^G4:4 A3^C4^F4:4 B3^D4^B4:4
C5:8-(bSL) F5:8 F4^A4^D5:4(eSL) |
beat(6/4) C5:8-(bSL) F5:8 F4^B4^D5:4(eSL)
D4^G4^B4:4 E4n^G4^C5:4 G3^C4^G4:4 A3^C4^F4:4 |
beat(5/4) F4:4(TE) G4:4(TE) D4:4(TE)
F4:8(bSL,TE) G4:8 C4:4(eSL,TE) |
beat(6/4) G4:8-(bSL,TE) A4:8 F4:4(eSL,TE)
F4^F5:4 F4^D5:4 C5:8-(bSL) B4:8 F4:4(eSL) |
beat(5/4) F4:4(TE) G4:4(TE) D4:4(TE)
F4:8(bSL,TE) G4:8 E4:4(eSL,TE) |
beat(6/4) B4:8-(bSL,TE) C5:8 A4b:4(eSL)
A4^A5b:4 A4^F5:4 E5:8-(bSL) D5b:8 A4:4(eSL) |
dynamics(p) A3b^A4b:4(bCR) B3^B4:4 A3^A4:4
B3^B4:8- C4^C5:8- E4^E5:8- B3^B4:8 A3^A4:4(eCR) |
dynamics(f) D4b^F4^A4b^D5b:8- E4^A4^C5^E5:8
F4^A4^D5^F5:8- A5b:8- G4b^B4^E5^G5b:8-
F4^A4^D5^F5:8 E4^A4^C5^E5:8-(bDE) G4^G5:8-
F4^B4^D5^F5:8 D4^D5:8 E4^A4^C5^E5:4(eDE) |
beat(5/4) dynamics(mf) A3b^A4b:4(bCR) B3^B4:4
A3^A4:4 B3^B4:8- C4^C5:8- E4^E5:8- B3^B4:8 |
beat(6/4) C4^C5:4 D4n^D5n:4 C4^C5:4 D4^D5:8-
F4^F5:8- G4^G5:8- D4^D5:8 C4^C5:4(eCR) |
```

ML-G SYNTAX

ML-G SYNTAX IN MODIFIED EBNF(EXTENDED BACKUS NAUR FORM).

```
<score>
     ::= %score <declarative block> <staff block>+
```

```
<declarative block>
     ::= <performance mark>*
<staff block>
     ::= %staff <performance mark>* <part block>+
<part block>
     ::= %part <measure>+
<measure>
     ::= <notational symbol>* <bar line>
<notational symbol>
     ::= <performance mark> | <note symbol> |
         <qualifier>
<performance mark>
     ::= <tempo mark> | <key signature> |
         <dynamic mark> | <time signature> |
         <clef signature> | <instrument mark>
<tempo mark>
     ::= tempo"("<tempo mark type> |
         <tempo word type>")"
<key signature>
     ::= key"("<key signature type>")"
<dynamic mark>
     ::= dynamics"("<dynamic mark type>")"
<time signature>
     ::= beat"("<time signature type> |
         <time word type>")"
<clef signature>
     ::= clef"("<clef signature type>")"
<instrument mark>
     ::= instrument"("<instrument type>")"
<note symbol>
     ::= <note> | <rest> | <multiplet> | <chord> |
         <ornamental note> | <tremolo>
<note>
     ::= <pitch>:<duration><beam>("("<qualifier>
         (,<qualifier>)*")")?
```

ML-G SYNTAX (CONTINUED)

```
<rest>
     ::= R:<duration>("("<qualifier>
         (,<qualifier>)*")")?
<multiplet>
     ::= "<"<number> ((" "<note>) |
         (" "<rest>))+">"
<chord>
     ::= <pitch^>+<note>
<ornamental note>
     ::= <ornamental note symbol><note>
```

```
<tremolo>
     ::= <tremolo note type><pitch>(^<pitch>)*
         ("+"<pitch>(^<pitch>)*)?:<duration>
<pitch>
     ::= <pitch class><octave><accidental>
<bar line mark>
     ::= <repeat mark>?<bar line mark>
         <repeat mark>?
```

N.B. * any number of element including none
N.B. + at least one element
N.B. ? if any
N.B. | or
N.B. "" terminal mark (token) /* escape symbol */
N.B. <> nonterminal mark
N.B. () grouping ML SYMBOL LISTING (No. 1)

| | SCORE | STAFF | PART |
|---|---|---|---|
| CLEF | G (VIOLIN)<br>S (SOPRANO)<br>M (MEZZO SOPRANO)<br>C (ALTO)<br>T (TENOR)<br>F (BASS)<br>B (BARITON) | G (VIOLIN)<br>S (SOPRANO)<br>M (MEZZO SOPRANO)<br>C (ALTO)<br>T (TENOR)<br>F (BASS)<br>B (BARITON) | G (VIOLIN)<br>S (SOPRANO)<br>M (MEZZO SOPRANO)<br>C (ALTO)<br>T (TENOR)<br>F (BASS)<br>B (BARITON) |
| KEY | #0 (C, A)<br>#1 (G, E)<br>#2 (D, H)<br>#3 (A, FIS)<br>#4 (E, CIS)<br>#5 (H, GIS)<br>#6 (FIS,DIS)<br>#7 (CIS,AIS)<br>b1 (F, A)<br>b2 (B, G)<br>b3 (ES, C)<br>b4 (AS, F)<br>b5 (DES, B)<br>b6 (GES, ES)<br>b7 (CES, AS) | #0 (C, A)<br>#1 (G, E)<br>#2 (D, H)<br>#3 (A, FIS)<br>#4 (E, CIS)<br>#5 (H, GIS)<br>#6 (FIS,DIS)<br>#7 (CIS,AIS)<br>b1 (F, A)<br>b2 (B, G)<br>b3 (ES, C)<br>b4 (AS, F)<br>b5 (DES, B)<br>b6 (GES, ES)<br>b7 (CES, AS) | #0 (C, A)<br>#1 (G, E)<br>#2 (D, H)<br>#3 (A, FIS)<br>#4 (E, CIS)<br>#5 (H, GIS)<br>#6 (FIS,DIS)<br>#7 (CIS,AIS)<br>b1 (F, A)<br>b2 (B, G)<br>b3 (ES, C)<br>b4 (AS, F)<br>b5 (DES, B)<br>b6 (GES, ES)<br>b7 (CES, AS) |

| | | | |
|---|---|---|---|
| D | PPP | PPP | PPP |
| Y | PP | PP | PP |
| N | P | P | P |
| A | MP | MP | MP |
| M | MF | MF | MF |
| I | F | F | F |
| C | FF | FF | FF |
| S | FFF | FFF | FFF |

ML SYMBOL LISTING (No. 2)

| | SCORE | STAFF | PART |
|---|---|---|---|
| | 2/2 | 2/2 | 2/2 |
| | 2/4 | 2/4 | 2/4 |
| | 2/8 | 2/8 | 2/8 |
| | 3/2 | 3/2 | 3/2 |
| | 3/4 | 3/4 | 3/4 |
| | 3/8 | 3/8 | 3/8 |
| | 4/4 | 4/4 | 4/4 |
| T | 4/8 | 4/8 | 4/8 |
| I | 6/4 | 6/4 | 6/4 |
| M | 6/8 | 6/8 | 6/8 |
| E | 9/8 | 9/8 | 9/8 |
| | 9/16 | 9/16 | 9/16 |
| | 12/8 | 12/8 | 12/8 |
| | 12/16 | 12/16 | 12/16 |
| | 5/4 | 5/4 | 5/4 |
| | 5/8 | 5/8 | 5/8 |
| | 7/4 | 7/4 | 7/4 |
| | 7/8 | 7/8 | 7/8 |
| | 8/8 | 8/8 | 8/8 |
| | GRAVE | GRAVE | GRAVE |
| | LARGO | LARGO | LARGO |
| | LENTO | LENTO | LENTO |
| T | ADAGIO | ADAGIO | ADAGIO |
| E | LARGHETTO | LARGHETTO | LARGHETTO |
| M | ANDANTE | ANDANTE | ANDANTE |
| P | ANDANTINO | ANDANTINO | ANDANTINO |
| O | MODERATE | MODERATE | MODERATE |
| | ALLEGRETTO | ALLEGRETTO | ALLEGRETTO |
| | ALLEGRO | ALLEGRO | ALLEGRO |
| | VIVACE | VIVACE | VIVACE |

ML SYMBOL LISTING (No. 3)

| | | PART |
|---|---|---|
| PITCH | PITCH CLASS | C<br>D<br>E<br>F<br>G<br>A<br>B |
| | OCTAVE | 0<br>1<br>2<br>3<br>4<br>5<br>6<br>7<br>8 |
| | ACCIDENTAL | # (SHARP)<br>b (FLAT)<br>n (NATURAL)<br>x (DOUBLE ShARP)<br>w (DOUBLE FLAT) |
| DURATION | NOTE VALUE | 1 (WHOLE)<br>2 (HALF)<br>4 (QUARTER)<br>8 (EIGHTH)<br>16 (SIXTEENTH)<br>32 (THIRTY-SECOND)<br>64 (SIXTY-FOURTH) |

LISTING (No. 4)

| | | PART |
|---|---|---|
| DURATION | DOT | . (DOT)<br>.. (DOUBLE DOT) |
| BEAM | | - (BEAM) |

| | | |
|---|---|---|
| MULTIPLET | | <i ...> /* NUMBER */ |
| CHORD (SIMULTANEITY) | | ^ |
| TREMOLO | | 1& (TREMOLO ♪ )<br>2& (TREMOLO ♫ )<br>3& (TREMOLO ♬ )<br>+ (TREMOLO BETWEEN TWO PITCHS) |
| ORNAMENTAL NOTE | | A& (ACCIACCATURA)<br>D& (DOUBLE APPOGGIATURA)<br>L& (LONG APPOGGIATURA)<br>N& (NACHSCHLAG) |
| QUALI-FIER | SINGLE MARK | AC (ACCENT)<br>AL (ACCELERANDO)<br>AR (ARCO)<br>BR (BREATH)<br>CD (CODA)<br>CO (CON SORDINO)<br>CR (CRESCENDO)<br>DE (DECRESCENDO)<br>DC (DA CAPO)<br>DI (DIMINUENDO)<br>DS (DAL SEGNO) |

ML SYMBOL LISTING (No. 5)

| | | PART |
|---|---|---|
| | SINGLE MARK | FE (FERMETA)<br>FI (FINE)<br>FZ (FORZANDO, FORZATO)<br>IT (INVERTED TURN)<br>MO (MORDENT)<br>PE (PEDAL ON)<br>PI (PIZZICATO)<br>PO (PEDAL OFF)<br>PR (PRALLTRILLER)<br>RA (RALLENTANDO)<br>RF (RINFORZANDO, RINFORZATO)<br>RI (RITARDANDO)<br>RT (RITENUTO) |

| | | |
|---|---|---|
| QUALI-FIER | | SE (SEGNO)<br>SF (SFORZANDO, SFORZATO)<br>SG (STRINGENDO)<br>SM (STACCATISIMO)<br>SS (SENZA SORDINO)<br>ST (STACCATO)<br>TC (TRE CORDA)<br>TE (TENUTO)<br>TR (TRILL)<br>TU (TURN)<br>UC (UNA CORDA) |
| | COLLEC-TIVE MARK | b8A (8VA ALTA START)<br>e8A (8VA ALTA END)<br>b8B (8VA BASSA START)<br>e8B (8VA BASSA END)<br>bBI (BIS START)<br>eBI (BIS END) |

ML SYMBOL LISTING (No. 6)

| | | SCORE | STAFF | PART |
|---|---|---|---|---|
| QUALIFIER | COLLECTIVE MARK | | | bCR (CRESCENDO START)<br>eCR (CRESCENDO END)<br>bDE (DECRESCENDO START)<br>eDE (DECRESCENDO END)<br>bGL (GLISSANDO START)<br>eGL (GLISSANDO END)<br>bQU (QUARTER START)<br>eQU (QUARTER END)<br>bRP (REPEAT START)<br>eRP (REPEAT END)<br>bSL (SLUR START)<br>eSL (SLUR END)<br>bTE (TER START)<br>eTE (TER END)<br>bTI (TIE START)<br>eTI (TIE END)<br>bVO (VOLTA START)<br>eVO (VOLTA END) |

| | | | |
|---|---|---|---|
| OTHERS | %score (START OF SCORE) | %staff (START OF STAFF) | %part (START OF PART)<br><br>\| (BAR LINE)<br>/ (DOUBLE BAR LINE)<br>$ (ENDING DOUBLE BAR)<br>/* (START OF COMMENT)<br>*/ (END OF COMMENT) |

ML-P FILE EXAMPLE

```
%score
timebase(96)
%part
clef(G)
beat(5/4)
key(b2)
tempo(4=130)
instrument(piano)
[67:96*96:100]
[65:96*96:100]
[70:96*96:100]
[72:48*48:100]
[77:48*38:100]
[74:96*96:100]
beat(6/4)
[72:48*48:100]
[77:48*48:100]
[74:96*96:100]
[70:96*96:100]
[72:96*96:100]
[67:96*96:100]
[65:96*96:100]
beat(5/4)
[58:0*76:100]
[62:0*76:100]
[67:96*76:100]
[57:0*76:100]
[60:0*76:100]
[65:96*76:100]
[58:0*76:100]
[62:0*76:100]
/* to second
   column */
```

```
[70:96*76:100]
[72:48*48:100]
[77:48*48:100]
[65:0*76:100]
[69:0*76:100]
[74:96*76:100]
beat(6/4)
[72:48*48:100]
[77:48*48:100]
[65:0*76:100]
[70:0*76:100]
[74:96*76:100]
[62:0*76:100]
[67:0*76:100]
[70:96*76:100]
[64:0*76:100]
[67:0*76:100]
[72:96*76:100]
[55:0*76:100]
[60:0*76:100]
[67:96*76:100]
[57:0*76:100]
[60:0*76:100]
[65:96*76:100]
beat(5/4)
[65:96*96:100]
[67:96*96:100]
[62:96*96:100]
[65:48*48:100]
[67:48*48:100]
[60:96*96:100]
/* to third
   column */
```

```
beat(6/4)
[67:48*48:100]
[69:48*48:100]
[65:96*96:100]
[65:0*76:100]
[77:96*76:100]
[65:0*76:100]
[74:96*76:100]
[72:48*48:100]
[70:48*48:100]
[65:96*76:100]
beat(5/4)
[65:96*96:100]
[67:96*96:100]
[62:96*96:100]
[65:48*48:100]
[67:48*48:100]
[63:96*96:100]
beat(6/4)
[70:48*48:100]
[72:48*48:100]
[68:96*76:100]
[68:0*76:100]
[80:96*76:100]
[68:0*76:100]
[77:96*76:100]
[75:48*48:100]
[73:48*48:100]
[68:96*76:100]
[56:0*76:40]
[68:96*76:40]
[58:0*76:41]
```

ML-P SYNTAX

ML-P SYNTAX IN MODIFIED EBNL
(EXTENDED BACKUS NAUR FORM).

```
<score>
     ::= %score <declarative block> <part block>+
<declarative block>
     ::= <parformance mark>*
<part block>
     ::= %part (<note symbol> |
         <performance mark>)*
<performance mark>
     ::= <time base> | <tempo mark> |
         <key signature> | <time signature> |
         <clef signature> | <instrument mark>
<time base>
     ::= timebase"("<time base type>")"
<tempo mark>
     ::= tempo"("<tempo mark type>")"
<key signature>
     ::= key"("<key signature type>")"
<time signature>
     ::= beat"("<time signature type>")"
<clef signature>
     ::= clef"("<clef signature type>")"
<note symbol>
     ::= [<actual pitch>:<step time>
         "*"<gate time>:<actual loudness>]
```

What is claimed is:

1. An apparatus for interpreting a notated music, comprising:

music symbol string storage means for storing a string of coded music notational symbols which represent a written music, said string of coded music notational symbols being vague to an extent that musical interpretation of said string is required for its performance realization; and interpreting means for interpreting said string from said music symbol string storage means to provide performance data which specifies a pitch, note-on time, duration and loudness, of each note to be played and which is thus specific to an extent that an automatic performance of said written music can be realized based on said performance data without any further musical interpretation.

2. An apparatus for interpreting a notated music, comprising:

music symbol string storage means for storing a string of coded music notational symbols which represents a written music; and interpreting means for interpreting said string from said music symbol string storage means to provide a performance symbol string containing performance information on each note;

said interpreting means comprising:

reference loudness evaluating means for evaluating a reference loudness of said written music based on a distribution of dynamic marks contained in said string of coded music notational symbols; and individual loudness determining means for determining loudness of each individual dynamic mark contained in said string of coded music notational symbols from said reference loudness.

3. An apparatus for interpreting a notated music, comprising:

music symbol string storage means for storing a string of coded music notational symbols which represents a written music; and interpreting means for interpreting said string from said music symbol string storage means to provide a string of performance data containing performance parameters of each note;

said interpreting means comprising:

note group affecting symbol detecting means for detecting a symbol in said string of coded music notational symbols which affects a note group; and symbol interpreting means for interpreting said detected symbol to allocate a time varying performance parameter to said note group affected by said detected symbol.

4. An apparatus for interpreting a notated music, comprising:

music symbol string storage means for storing a string of coded music notational symbols which represents a written music; and interpreting means for interpreting said string of coded music notational symbols to provide a performance data string containing performance parameters of each note;

said interpreting means comprising:

symbol detecting means for detecting a symbol of a predetermined type in said string of coded music notational symbols which affects a note; and loudness and duration control means for interpreting said detected symbol to control both a performance parameter value of duration and a performance parameter value of loudness, of said note affected by said detected symbol.

5. An apparatus for interpreting a notated music, comprising:

music symbol string storage means for storing a string of coded music notational symbols which represents a written music; and interpreting means for interpreting said string of coded music notational symbols to provide a performance symbol string containing performance parameters of each note;

said interpreting means comprising:

extensive symbol detecting means for detecting an extensive symbol in said string of coded music notational symbols which has an extensive influence on a plurality of notes of the written music;

extensive symbol interpreting means for interpreting said detected extensive symbol to provide an extensive interpretation value for said plurality of notes;

local symbol detecting means for detecting a local symbol in said string of coded music notational symbols which has a local influence on a number of notes of the written music which is less than said plurality of notes;

local symbol interpreting means for interpreting said detected local symbol to provide a local interpretation value; and performance parameter determining means for determining a performance parameter value of a note in accordance with said extensive interpretation value and in accordance with said local interpretation value.

6. The apparatus of claim 5 wherein said performance parameter determining means comprises combining means for combining said extensive interpretation value with said local interpretation value to determine said performance parameter of said note.

7. The apparatus of claim 5 wherein said performance parameter determining means comprises selecting means for selecting either said extensive interpretation value or said local interpretation value depending on a type of said extensive symbol and said local symbol to determine said performance parameter of said note.

8. An apparatus for providing musical interpretation of a notated music, comprising:

music symbol string storage means for storing a string of coded music notational symbols which represents a written music having a plurality of parts; and interpreting means for interpreting said string of coded music notational symbols to provide performance information on said plurality of parts and containing a corresponding number of part performance blocks;

said interpreting means comprising:

part type identifying means for identifying a part type of each of said part performance blocks based on part symbols contained in said string of coded music notational symbols; and loudness proportion controlling means for adjusting loudness of said each of said part performance blocks based on said identified part type to establish a desired volume proportion of said plurality of parts.

9. An apparatus for providing music interpretation of a notated music, comprising:

music symbol string storage means for storing a string of coded music notational symbols which represents a written music including chords; and interpreting means for interpreting said string of coded music notational symbols to provide performance information on sounds including chord members;

said interpreting means comprising:

chord member identifying means for identifying a type of each chord member in said performance information based on chord member symbols contained in said string of coded music notational symbols; and loudness proportion controlling means for adjusting loudness of said each chord member based on said identified type to establish a desired volume proportion of chord members.

* * * * *

UNITED STATES PATENT AND TRADEMARK OFFICE

CERTIFICATE OF CORRECTION

PATENT NO. : 5,202,526

DATED : April 13, 1993

INVENTOR(S) : OHYA, Mayumi

It is certified that error appears in the above-identified patent and that said Letters Patent is hereby corrected as shown below:

Title page, Section [56] References Cited,
Under "U.S. PATENT DOCUMENTS":

Line 1, "9/1981" should be --9/1982--.
Line 4, "6/1999" should be --6/1991--.

Signed and Sealed this

Second Day of August, 1994

*Attest:*

Bruce Lehman

BRUCE LEHMAN

*Attesting Officer*

*Commissioner of Patents and Trademarks*